US009079207B2

(12) United States Patent
Simpson

(10) Patent No.: US 9,079,207 B2
(45) Date of Patent: Jul. 14, 2015

(54) ADHESIVE APPLICATOR FOR THREADED DEVICES AND PROCESS FOR APPLYING ADHESIVE TO THREADED DEVICES

(75) Inventor: Royce Allen Simpson, Kokomo, IN (US)

(73) Assignee: FAIRFIELD MANUFACTURING COMPANY, INC., Lafayette, IN (US)

( * ) Notice: Subject to any disclaimer, the term of this patent is extended or adjusted under 35 U.S.C. 154(b) by 913 days.

(21) Appl. No.: 13/118,732

(22) Filed: May 31, 2011

(65) Prior Publication Data

US 2012/0308731 A1 Dec. 6, 2012

(51) Int. Cl.

*B05D 5/10* (2006.01)
*B05C 3/09* (2006.01)
*B05C 3/20* (2006.01)

(52) U.S. Cl.

CPC .... *B05C 3/09* (2013.01); *B05C 3/20* (2013.01)

(58) Field of Classification Search

CPC ..... B05C 3/09; B05C 3/20
USPC ..... 427/207.1, 421.1; 118/300, 326
See application file for complete search history.

(56) References Cited

U.S. PATENT DOCUMENTS

| | | | | |
|---|---|---|---|---|
| 3,995,074 | A | 11/1976 | Duffy et al. | |
| 4,155,327 | A | 5/1979 | Alexander et al. | |
| 4,279,943 | A | 7/1981 | Wallace | |
| 4,325,985 | A | 4/1982 | Wallace | |
| 4,372,245 | A | 2/1983 | Watson et al. | |
| 4,426,410 | A | 1/1984 | Watson et al. | |
| 4,428,982 | A | 1/1984 | Wallace | |
| 4,554,178 | A | 11/1985 | Yamamoto et al. | |
| 4,569,977 | A * | 2/1986 | Werber | 526/204 |
| 5,399,052 | A | 3/1995 | Volkmann et al. | |
| 5,413,638 | A | 5/1995 | Bernstein, Jr. et al. | |
| 5,417,529 | A | 5/1995 | Volkmann et al. | |
| 5,900,109 | A * | 5/1999 | Sanders et al. | 156/552 |
| 6,491,974 | B1 | 12/2002 | Gordon | |
| 7,032,769 | B2 | 4/2006 | Iida et al. | |
| 7,845,536 | B2 | 12/2010 | Viola et al. | |
| 2006/0024122 | A1 * | 2/2006 | Nealon et al. | 401/266 |

OTHER PUBLICATIONS

Loctite 263 TM, Technical Data Sheet , Nov. 2009, Henkel Corporation.

Marprene Tubing, Watson Marlow, Inc. 37 Upton Technology Park, Wilmington, MA 01887, United States of America, At Least As Early As May 26, 2011, www.watson-marlow.com.

* cited by examiner

*Primary Examiner* — Xiao Zhao
(74) *Attorney, Agent, or Firm* — Woodling, Krost and Rust

(57) ABSTRACT

An adhesive applicator includes a base portion and an adhesive distributing portion. The base portion includes a first passageway extending from the exterior of the base portion to and through an integral cylindrical portion of the base portion. The adhesive distributing portion includes a plurality of passageways therethrough in communication with the first passageway of the base portion. The plurality of passageways of the adhesive distributing portion extend to the exterior of the adhesive distributing portion. An adhesive pump forces adhesive to and through the first passageway of the base portion and into and through the plurality of passageways of the adhesive distributing portion to the exterior of the adhesive distributing portion. Adhesive emanates from the exterior of the adhesive distributing portion under the force of the adhesive pump and coats the threads of an internally threaded device. Another example coats the threads of an externally threaded device. Processes for coating internal and external threads are disclosed.

5 Claims, 16 Drawing Sheets

ADHESIVE APPLICATOR FOR THREADED DEVICES AND PROCESS FOR APPLYING ADHESIVE TO THREADED DEVICES

FIELD OF THE INVENTION

The invention is in the field of adhesive applicators which apply adhesive to threaded devices, primarily fasteners.

BACKGROUND OF THE INVENTION

U.S. Pat. No. 4,426,410 to Watson et al. entitled Method For Coating Internal Threads of Fasteners, states: "A method for coating the internal threads of a fastener includes a rotatable base for holding the fastener, and an applicator having a discharge orifice extending through its side wall which contacts the internal threads at a single point of tangency, the axis of the applicator being offset from the rotational axis of the base. Thus, an induced side load force is created at the point of tangency for effecting the pressing of discharged sealant into the roots of the threads. Differently sized internally threaded elements can be coated in accordance with the invention while using the same sealant applicator."

LOCTITE® is the trademark of the Henkel Corporation and is used in connection with an anaerobic adhesive for threadlocking. In particular, it is designed for the permanent locking and sealing of metallic threaded fasteners. A technical data sheet for LOCTITE® 263™, November 2009, Henkel Corporation, is submitted with this application as part of an information disclosure statement and is incorporated herein by reference hereto. LOCTITE® 263™ is one anaerobic adhesive used for threadlocking metallic threaded fasteners. Other adhesives including two-component adhesives may be used.

SUMMARY OF THE INVENTION

The invention is a liquid adhesive applicator for coating internally and externally threaded devices, primarily fasteners.

In regard to internally threaded devices, the adhesive applicator apparatus includes: a peristaltic pump to transport the liquid from a reservoir to an adhesive applicator portion which forces the liquid adhesive into the threads of an internally threaded device, and a recovery system to return unused adhesive to the liquid adhesive reservoir. The liquid adhesive is moved from the reservoir to the adhesive applicator portion by a peristaltic pump. The pump, through the use of a motor driven multi-lobed cam, moves the thread locker adhesive through the supply tube without contacting the liquid. This supplies adhesive to the pressure port of the adhesive applicator. The adhesive is then forced up a central supply passageway that intersects radial passageways to distribute the liquid adhesive evenly. The adhesive is forced through the radial passageways that intersect a circumferential groove. This allows the liquid adhesive to fill evenly around the entire diameter of the applicator. When an internally threaded fastener is placed on the applicator, the fit between the inside diameter of the threaded fastener and the outside diameter of the applicator is such that the adhesive is forced into the circumferential groove and the internal threads of the fastener. This evenly and completely fills all the threads in the area of the groove. When the fastener is then affixed to a mating threaded component, the adhesive is then spread to all of the threads of the fastener and the mating threaded component. The anaerobic adhesive then cures in the absence of oxygen to secure the metallic components to each other.

When there is no fastener in place on the applicator, the excess thread locker adhesive is allowed to collect in a drain well in the base portion of the adhesive applicator. During periods of non use the pump may be shut down. Short periods of non use will result in the recycling of adhesive via the drain well. From the well in the base portion, the liquid adhesive flows to the drain port where it is returned to the reservoir by gravity or a scavenging pump, to be recycled through the system. The entire adhesive application system is free from metal components in order to prevent reactions with the anaerobic thread locker. The adhesive applicator is plastic, preferably nylon. The adhesive applicator has no metal parts.

Still referring to internally threaded devices, the adhesive applicator includes a base portion and an adhesive distributing portion. The base portion includes a first passageway extending from the exterior of the base portion to and through an integral cylindrical portion of the base portion. The adhesive distributing portion includes a plurality of passageways therethrough in communication with the first passageway of the base portion. The plurality of passageways of the adhesive distributing portion extend to the exterior of the adhesive distributing portion. An adhesive pump forces adhesive to and through the first passageway of the base portion and into and through the plurality of passageways of the adhesive distributing portion to the exterior of the adhesive distributing portion. Adhesive emanates from the exterior of the adhesive distributing portion in an exterior groove under the force of the adhesive pump and coats the threads of a threaded device.

Still referring to internally threaded devices, the adhesive distributing portion includes an exterior and the base portion includes an adhesive drain well. The base portion includes an integral cylindrical portion and an exterior. The base portion includes a first passageway, the first passageway of the base portion extending from the exterior of the base portion to and through the integral cylindrical portion of the base portion. The adhesive distributing portion includes a second passageway therethrough in communication with the first passageway of the base portion. The second passageway of the adhesive distributing portion extends to the exterior of the adhesive distributing portion. A peristaltic adhesive pump forces adhesive to and through the first passageway of the base portion and into and through the second passageway of the adhesive distributing portion to the exterior of the adhesive distributing portion. The adhesive emanates from the exterior of the adhesive distributing portion in an exterior groove under the force of the adhesive pump. Use of peristaltic adhesive pumps is preferable as no pump part contacts the anaerobic adhesive directly. The tube used is oxygen permeable to prevent the anaerobic adhesive from setting up. The peristaltic pump engages only the outside of the pliable tube carrying the anaerobic adhesive. In this way, a clean and efficient pumping process is carried out with no chance of the anaerobic adhesive setting up on any metal parts of the pump in the absence of air or oxygen. Anaerobic adhesives adhere to metal surfaces in the absence of oxygen.

Still referring to internally threaded devices, the base portion and the adhesive distributing portion are plastic, preferably nylon. The base portion includes an upper cylindrical wall portion, and, the upper cylindrical wall portion of the base portion includes a plurality of integral tabs thereon. The tabs are used to support the internally threaded device. The device having internal threads engages the plurality of integral tabs and is substantially spaced apart from the upper cylindrical wall portion. The device having internal threads may be placed on the tabs of the upper portion of the base portion off center but, even in this condition, the adhesive emanating from the exterior of the adhesive distributing portion under the force of the adhesive pump completely coats all of the internal threads.

Still referring to internally threaded devices, the adhesive distributing portion preferably includes a plurality of passageways (plurality of second passageways) in communication with the first passageway of the base portion. The plurality of passageways of the adhesive distributing portion extend to the exterior of the adhesive distributing portion, and, the adhesive pump forces adhesive to and through the first passageway of the base portion and into and through the plurality of passageways of the adhesive distributing portion to the exterior of the adhesive distributing portion and also into an exterior groove.

Still referring to internally threaded devices, the exterior of the adhesive distributing portion includes a circumferential groove and the second passageway of the adhesive distributing portion extends to the circumferential groove in the exterior of the adhesive distributing portion. Alternatively, the exterior of the adhesive distributing portion includes a circumferential groove and the plurality of passageways of the adhesive distributing portion extend to the circumferential groove in the exterior of the adhesive distributing portion.

Still referring to internally threaded devices, an adhesive applicator comprises an adhesive distributing portion. The adhesive distributing portion includes an exterior and a passageway therethrough. The passageway includes a first end portion and a second end portion. The first end portion of the passageway of the adhesive distributing portion is interconnected to an adhesive pump. The second end portion of the passageway of the adhesive distributing portion terminates at the exterior of the adhesive distributing portion. The adhesive pump forces adhesive to and through the passageway of the adhesive distributing portion to the exterior of the adhesive distributing portion and the adhesive emanates from the exterior of the adhesive distributing portion into a groove under the force of the adhesive pump. The device having internal threads engages the base portion, the base portion supporting the device, and, the device surrounds the exterior of the adhesive distributing portion. Alternatively, the adhesive distributing portion includes a plurality of passageways therethrough and each passageway includes a first end portion and a second end portion. The first end portion of each of the passageways of the adhesive distributing portion is interconnected with an adhesive pump. The second end portion of each of the passageways of the adhesive distributing portion terminates at the exterior of the adhesive distributing portion. The adhesive pump forces adhesive to and through each of the passageways of the adhesive distributing portion to the exterior of the adhesive distributing portion. Adhesive emanates from the exterior of the adhesive distributing portion into a groove under the force of the adhesive pump.

In regard to externally threaded devices, another example of the adhesive applicator includes structure for coating externally threaded devices, for example, studs having external threads. The adhesive applicator includes a base portion and an adhesive distributing portion. The adhesive distributing portion includes a cylindrical bore therethrough, the cylindrical bore forming an interior surface, and the adhesive distributing portion also includes an exterior. The base portion includes an interior, an exterior and the base portion includes a first passageway therethrough extending from the exterior of the base portion to the interior of the base portion. The adhesive distributing portion includes a second passageway therethrough which extends to the interior of the adhesive distributing portion. An adhesive pump forces adhesive to and through the second passageway of the base portion and into and through the second passageway of the adhesive distributing portion to the interior of the adhesive distributing portion. Adhesive emanates from the interior of the adhesive distributing portion under the force of the adhesive pump and into an annulus. The base portion includes an adhesive drain well which collects adhesive that has not been used in coating the threads of a threaded device.

Still referring to externally threaded devices, alternatively, the adhesive distributing portion includes a plurality of second passageways and the plurality of second passageways of the adhesive distributing portion extend to the interior of the adhesive distributing portion. The adhesive distributing portion includes a circumferential groove in the exterior of the adhesive distributing portion which communicates with the second passageway. Alternatively, the adhesive distributing portion includes a circumferential groove in the exterior of the adhesive distributing portion and the circumferential groove communicates with the plurality of second passageways. Each of the plurality of the second passageways of the adhesive distributing portion extend radially to the interior of the adhesive distributing portion.

Still referring to externally threaded devices, the base portion includes an inner shoulder, the adhesive distributing portion engages the inner shoulder of the base portion, and the adhesive distributing portion resides within the interior of the base portion. The adhesive used in the applicator is preferably an anaerobic adhesive which adheres to metal in the absence of oxygen.

A process of applying adhesive to an internally threaded device is disclosed and claimed which includes the step of placing the threaded device upon the base portion of the adhesive applicator. The base portion supports the threaded device. Pumping anaerobic adhesive is performed utilizing a peristaltic pump to avoid contact of the anaerobic adhesive with the metal components of the pump. Rollers of the peristaltic pump compress a flexible tube pushing and forcing the anaerobic adhesive through the tube without contacting any metal parts of the tube. The anaerobic adhesive does not adhere to plastic or elastomeric materials. The peristaltic pump pumps anaerobic adhesive from a reservoir to the adhesive applicator for coating the threads of a threaded device. The adhesive is routed through a first passageway in the base portion of the adhesive applicator and then it is routed through a plurality of passageways in the adhesive distributing portion of the adhesive applicator. Adhesive is discharged from the plurality of passageways to the exterior of the adhesive distributing portion of the adhesive applicator and the threaded device surrounds the exterior of the adhesive distributing portion proximate the threaded device. Adhesive is forced into a gap between the adhesive distributing portion and the threaded device and the threads of the threaded device are coated with the adhesive.

The step of discharging adhesive from the plurality of passageways to the exterior of the adhesive distributing portion proximate the threaded device is followed by the step of spreading the adhesive in a circumferential groove in the exterior of the adhesive distributing portion of the adhesive applicator proximate the threaded device. The plurality of passageways in the adhesive distributing portion of the adhesive applicator are preferably radial passageways. An additional step of draining excess adhesive from the gap between the adhesive distributing portion and the threaded device is also preferably performed in the process.

A process of applying adhesive to an externally threaded device includes the steps of placing the threaded device upon a depth stop which controls the depth of insertion of the threaded device or stud into the adhesive applicator. Externally threaded devices may involve the use of a depth stop that is calibrated or sized for the location of the threads on the stop. The depth stop engages the base portion and the depth stop supports the threaded device. Adhesive is pumped utilizing a peristaltic pump from an adhesive reservoir to the adhesive applicator for coating threads of the threaded device. Adhesive is routed through a first passageway in the base portion of the adhesive applicator and it then spreads and flows in a circumferential groove in the exterior of the adhesive distributing portion of the adhesive applicator. The adhesive is routed through a plurality of passageways in the adhesive distributing portion of the adhesive applicator and is discharged from the plurality of passageways to an annulus in the interior of the adhesive distributing portion of the adhesive applicator. The adhesive distributing portion surrounds the threaded device and forces adhesive into a gap between the adhesive distributing portion and the threaded device coating the threads of the threaded device with the adhesive. The plurality of passageways in the adhesive distributing portion of the adhesive applicator are preferably radial passageways. Preferably, excess adhesive is drained from the gap between the adhesive distributing portion and the threaded device. When the fastener is then affixed to a mating threaded component, the adhesive is then spread to all of the threads of the fastener and the mating threaded component.

It is an object of the invention to facilitate the application of adhesive coating to threaded fasteners.

It is an object of the invention to facilitate the application of adhesive coating to threaded fasteners made of metal.

It is an object of the invention to apply anaerobic thread locking adhesive to threaded fasteners made of metal in a controlled manner so that the threaded fasteners are completely covered with adhesive.

It is an object of the invention to apply anaerobic thread locking adhesive to threaded fasteners in a way to minimize waste of adhesive.

It is an object of the invention to apply anaerobic thread locking adhesive to threaded fasteners using a plastic adhesive applicator.

It is an object of the invention to apply anaerobic thread locking adhesive to threaded fasteners made of metal using a nylon adhesive applicator.

It is an object of the invention to apply the correct amount of thread locking adhesive to the threads of threaded fasteners made of metal.

It is an object of the invention to apply anaerobic thread locking adhesive to threaded fasteners made of metal.

These and other objects will be best understood when reference is made to the drawings and the description of the invention hereinbelow.

DESCRIPTION OF THE INVENTION

Figure 1:
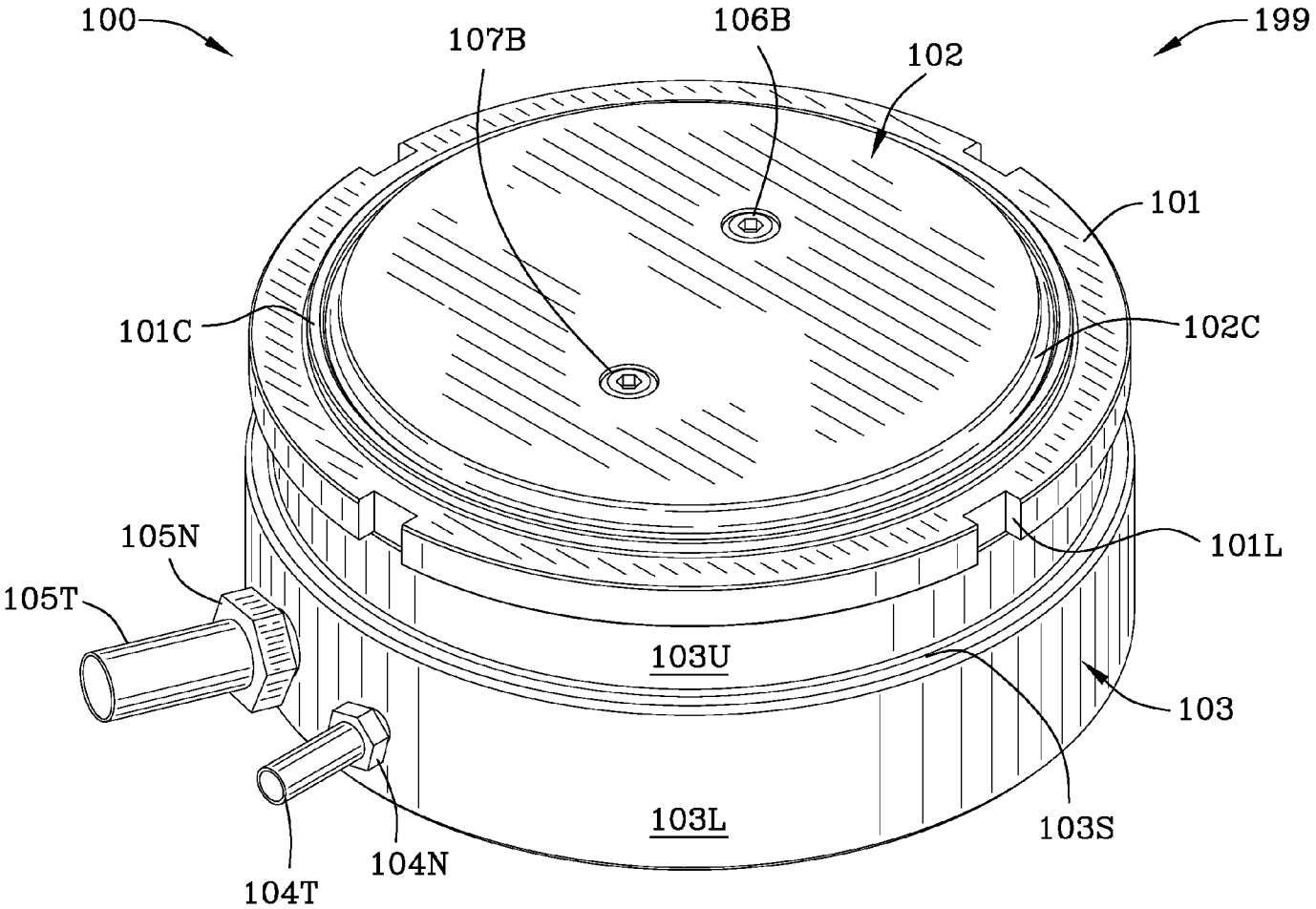
FIG. 1 is a perspective view of the first example of the adhesive applicator illustrating the pressure tube, the drain tube, the base portion, and the adhesive distributing portion of the applicator with an internally threaded fastener placed around the adhesive distributing portion of the applicator.

FIG. 1 is a perspective view 100 of the first example of the adhesive applicator 199 illustrating the pressure tube 104T, the drain tube 105T, the base portion 103, and the adhesive distributing portion 103 of the applicator with an internally threaded fastener 101 placed around the adhesive distributing portion 102 of the adhesive applicator. The threaded fastener 101 includes a cylindrical lip 101C. The threaded fastener is shown by example only and other threaded fasteners may be used. Nut 104N secures pressure supply tube 104T to the pressure supply port. Nut 105N secures drain supply tube 105T to the drain supply port. An adhesive distributing portion 102 includes a chamfer 102C illustrated in FIG. 1. Threaded fastener 101 includes lugs 101L and these lugs are used for tightening the fastener to another assembly not shown. Base portion 103 is illustrated in FIG. 1 and includes a lower portion 103L, upper portion 103U, and step 103S. Bolts, 106B, 107B, securing adhesive distributing portion 102 to the base portion 103 are also shown in FIG. 1.

Still referring to FIG. 1, the structure illustrated is generally cylindrically shaped and is preferably made of nylon. Other plastics may be used. Plastics are used because the anaerobic adhesives used in securing threaded devices made of metal to other metal components do not adhere to plastics.

Figure 1A:
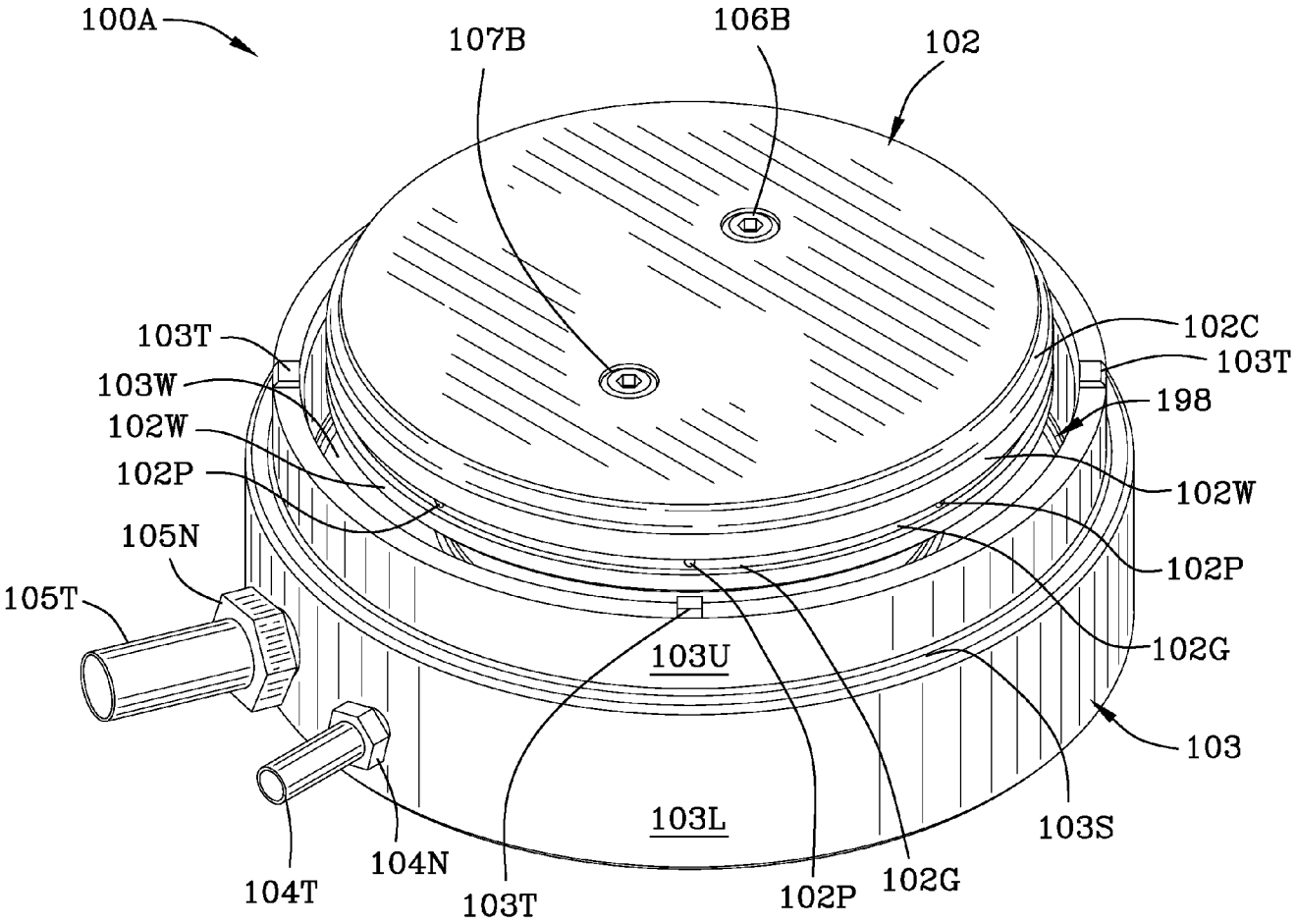
FIG. 1A is a perspective view of the first example of the adhesive applicator illustrating the pressure tube, the drain tube, the base portion, and the adhesive distributing portion of the applicator without a threaded fastener placed around the adhesive distributing portion of the applicator.
Figure 1B:
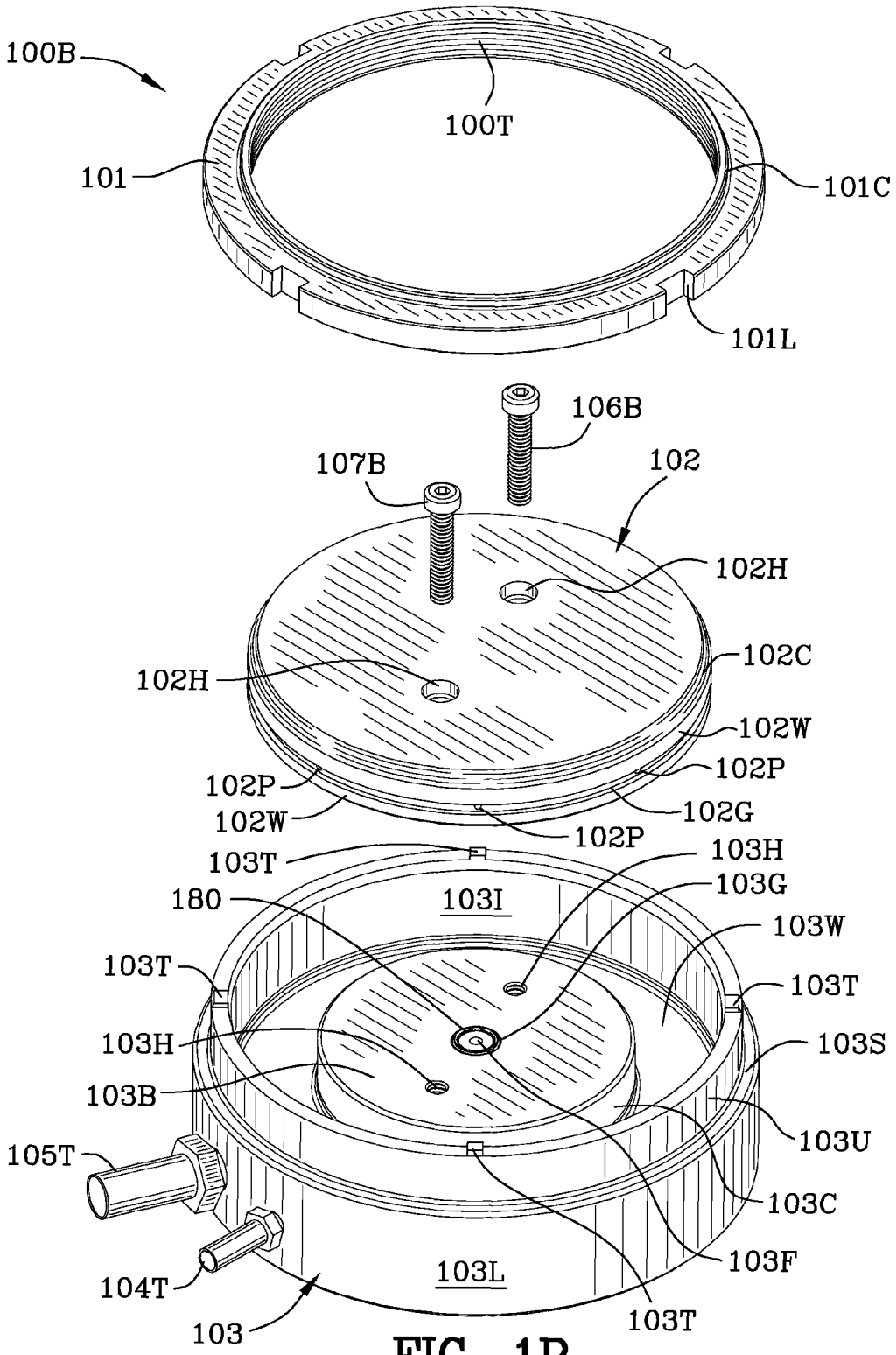
FIG. 1B is an exploded perspective view of the first example of the adhesive applicator illustrated in FIG. 1.

FIG. 1A is a perspective view 100A of the first example of the adhesive applicator 199 illustrating the pressure tube 104T, the drain tube 105T, the base portion 103, and the adhesive distributing portion 102 of the applicator without a threaded fastener placed around the adhesive distributing portion 102 of the adhesive applicator. Circumferential groove 102G is illustrated in the exterior wall 102W of the adhesive distributing portion 102. Adhesive emanates from distribution ports 102P and spreads in the circumferential groove 102G when an internally threaded device, for example bearing nut 101, is in place as indicated in FIGS. 1 and 1B. Slot 198 permits adhesive not used on threads 101T of the threaded device 101 to fall under the influence of gravity to well 103W in the base portion. Slot 198 provides a path for adhesive to flow when no threaded device resides around the adhesive distributing portion. Integral tabs 103T are shown in FIG. 1A and the bearing nut 101 sits on and is supported by said tabs as illustrated in FIG. 1. Tabs 103T space the bearing nut apart from the upper portion 103U of the base portion.

FIG. 1B is an exploded perspective view 100B of the first example of the adhesive applicator 199 illustrated in FIG. 1. Inner threads 101T are illustrated in bearing lock device 101. Adhesive distributing portion 102 with through holes 102H are illustrated along with bolts 106B, 107B which interengage threaded holes 103 in the upper surface 103B of cylindrical inner portion 103C of the base portion 103. Still referring to FIG. 1B, circular seal recess 103G is illustrated in the upper surface 103B. Seal 180 shown in FIG. 1B resides in circular seal recess 103G. Seal 180 is an elastomeric seal and is best viewed in FIG. 2. FIG. 2 is a cross-sectional view 200 of the first example of the adhesive applicator 199 taken along the lines 2-2 of FIG. 1G.

Still referring to FIG. 1B, centrally located flow port 103F for communicates adhesive from the base portion 103 to the adhesive distributing portion 102. Flow port 103F is interconnected to pressure tube 104T as described below and as illustrated in FIG. 2. Drain well 103W is illustrated well in FIG. 1B and functions as an accumulator for unused adhesive.

Figure 1C:
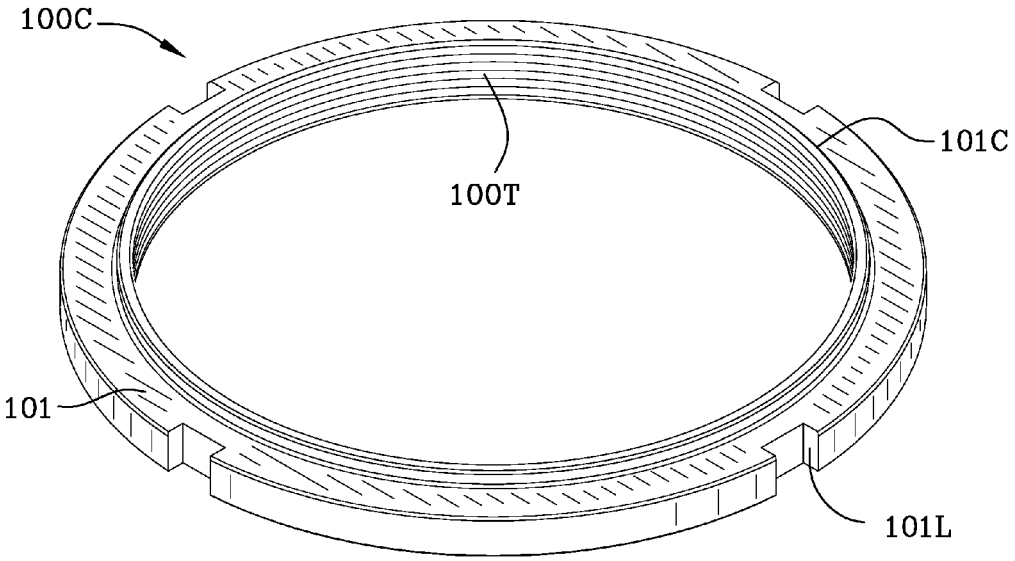
FIG. 1C is an enlarged portion of FIG. 1B illustrating the internally threaded fastener.
Figure 1D:
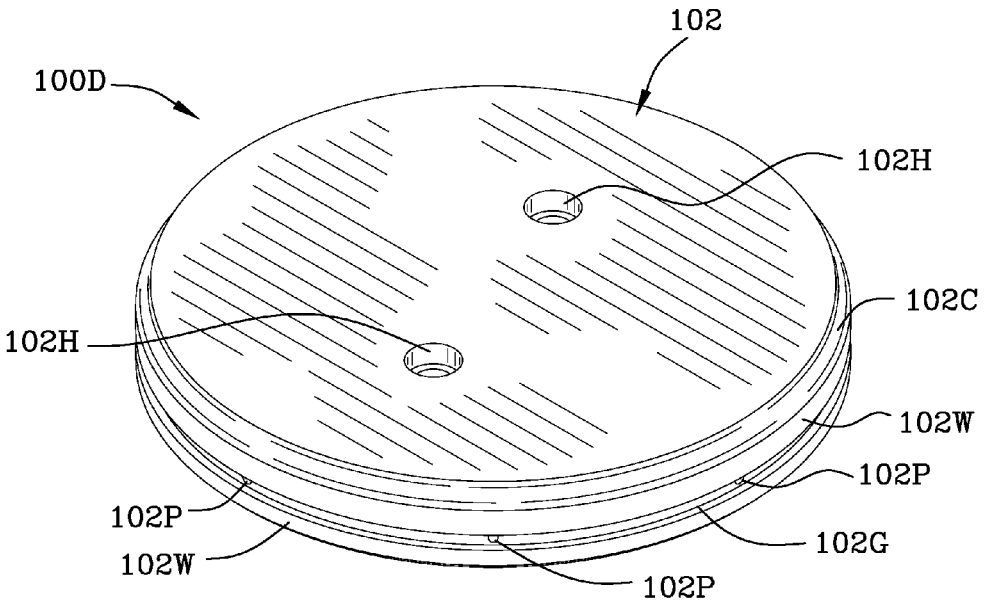
FIG. 1D is an enlarged portion of FIG. 1B illustrating the adhesive distributing portion of the first example of the adhesive applicator.
Figure 1E:
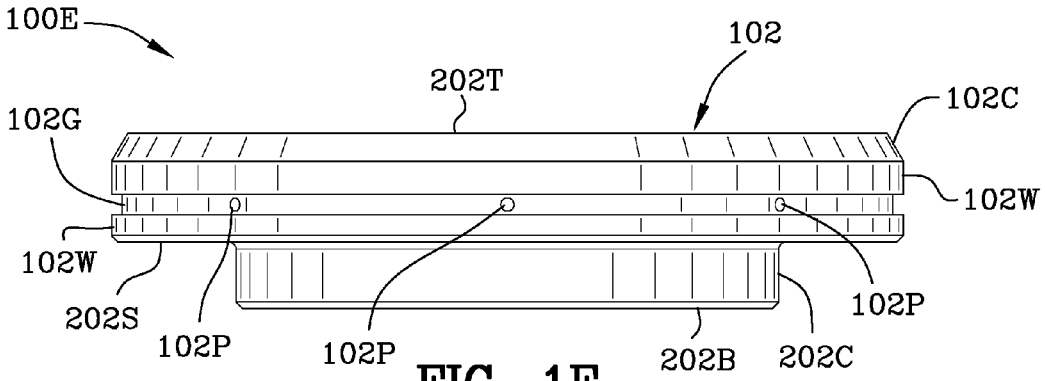
FIG. 1E is a front view of the adhesive distributing portion of the first example of the adhesive applicator illustrated in FIGS. 1D, 1B and 1A.
Figure 1F:
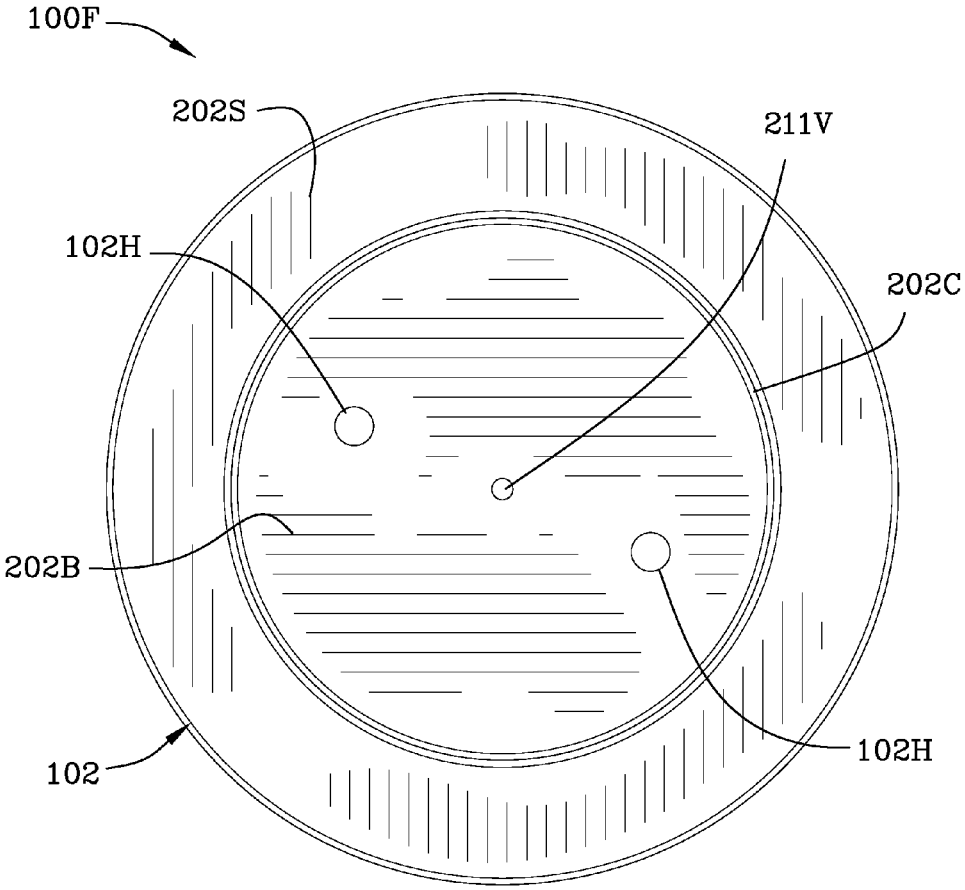
FIG. 1F is a bottom view of the adhesive distributing portion of the first example of the adhesive applicator illustrated in FIGS. 1D, 1B and 1A.

FIG. 1C is an enlarged portion 100C of FIG. 1B illustrating more detail of the threads 101T of threaded fastener 101. FIG. 1D is an enlarged portion 100D of FIG. 1B illustrating more detail of the discharge ports 102P in the circumferential groove 102G the adhesive distributing portion 102 of the first example of the adhesive applicator 199. FIG. 1E is a front view 100E of the adhesive distributing portion 102 of the first example of the adhesive applicator 199 illustrated in FIGS. 1D, 1B and 1A. FIG. 1F is a bottom view 100F of the adhesive distributing portion 102 of the first example of the adhesive applicator 199 illustrated in FIGS. 1D, 1B and 1A. FIG. 1F illustrates the cylindrically shaped bottom portion 202B and the shoulder 202S. Shoulder 202S of the adhesive distributing portion, and the outer surface of the cylindrically shaped 202C bottom portion of the adhesive distributing portion are illustrated in FIG. 1F. The integral cylindrical portion 103C of base portion 103 of adhesive applicator, the well portion 103W and the inner wall 103I of the base portion 103 form a drain passage (drain well) from which unused adhesive is recycled to a reservoir 601R. See FIGS. 1 and 2.

Figure 6:
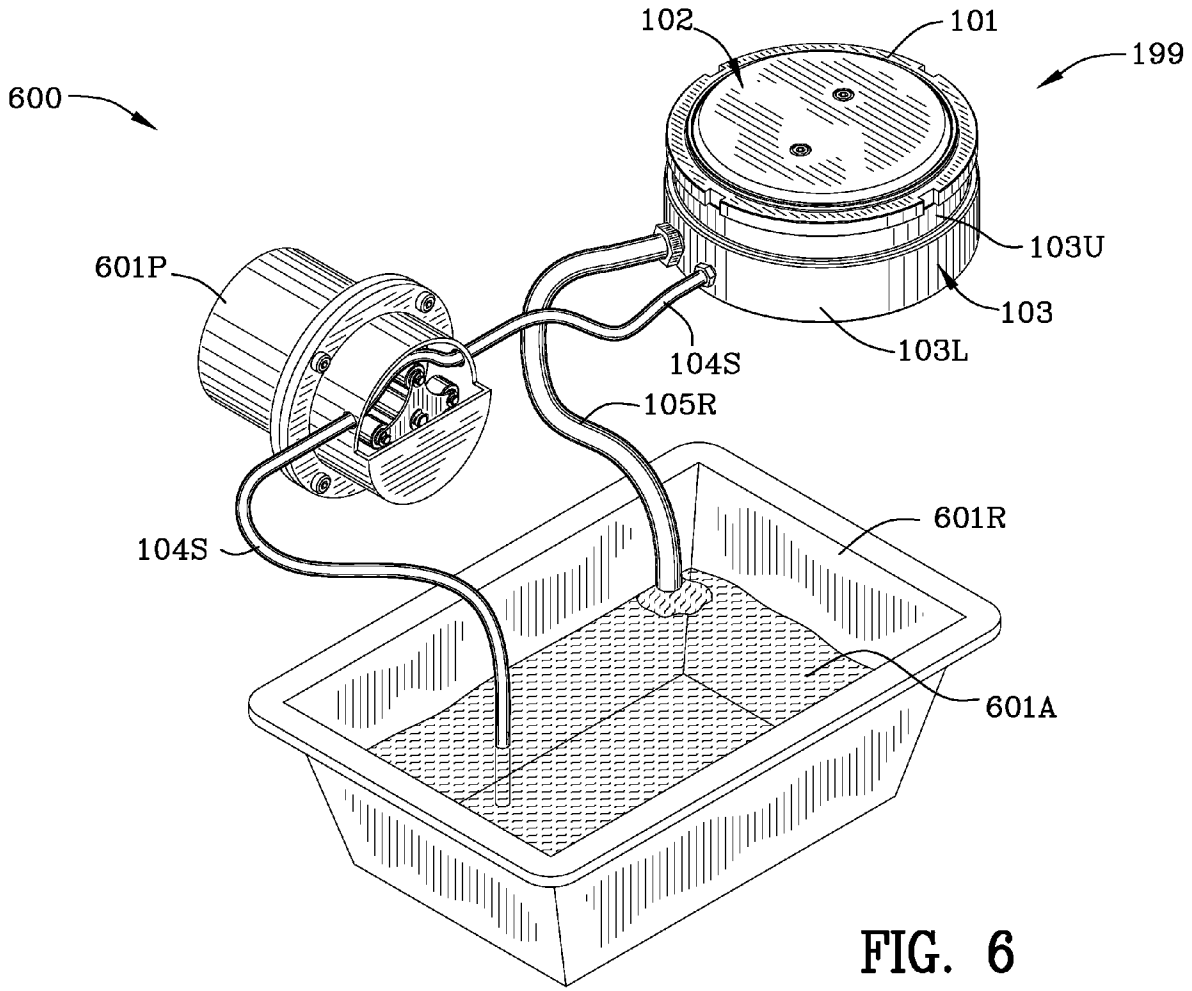
FIG. 6 is a schematic view of a peristaltic pump, an adhesive reservoir, and the first example of the adhesive applicator.
Figure 6A:
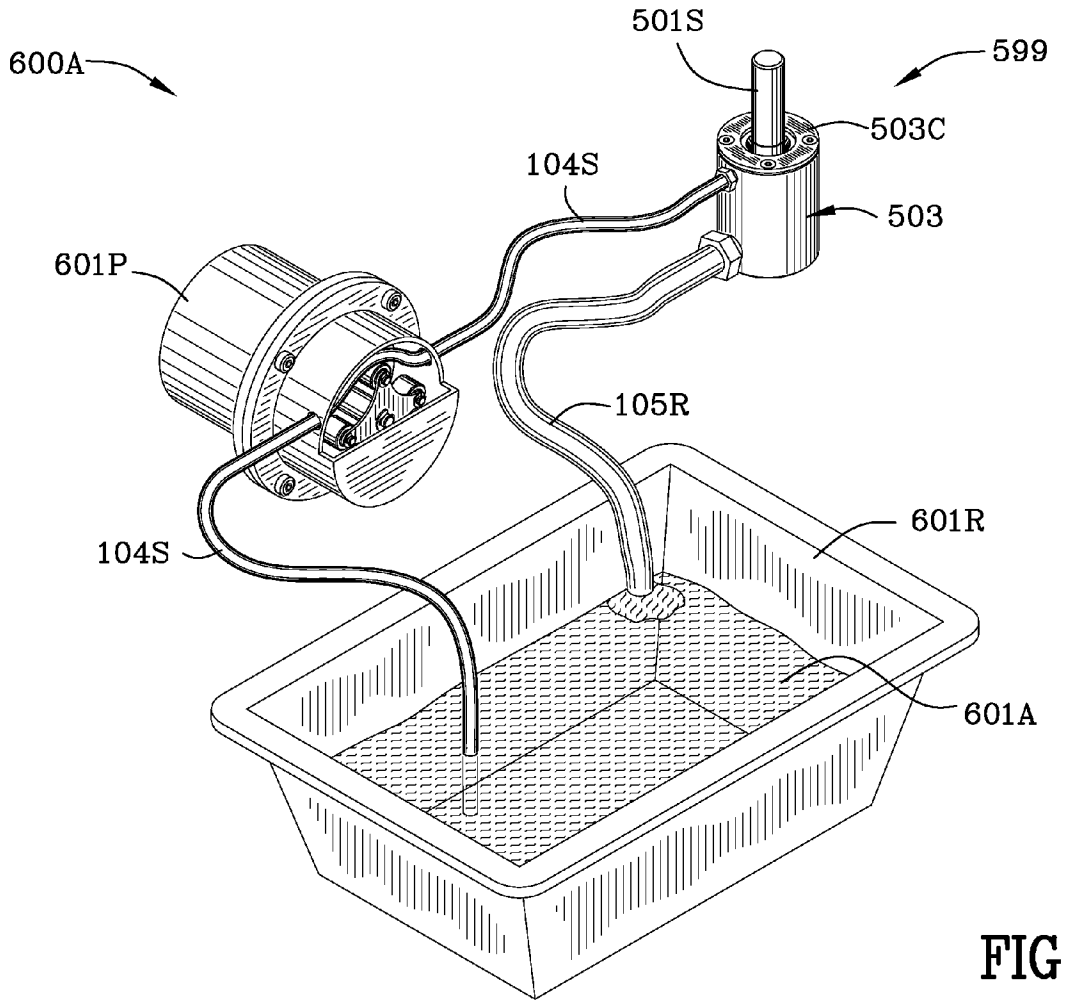
FIG. 6A is a schematic view of a peristaltic pump, an adhesive reservoir, and the second example of the adhesive applicator.

FIG. 6 is a schematic view 600 of a peristaltic pump 601P, an adhesive reservoir 601R, and the first example of the adhesive applicator 199 which shows the adhesive application from a system standpoint. FIG. 6 also illustrates a flexible adhesive supply tube 104S leading from reservoir 601R, through pump 601P and to the supply port of the adhesive applicator 199. Drain return line 105R extends from the drain port of the adhesive applicator 199 to the reservoir 601R. The adhesive is denoted by reference numeral 601A. Reservoir 601R is also made of plastic to prevent the adhesive from setting up in the reservoir. FIG. 6A is a schematic view 600A of a peristaltic pump 601P, an adhesive reservoir 601R, and the second example of the adhesive applicator 599 similar to FIG. 6.

Figure 1G:
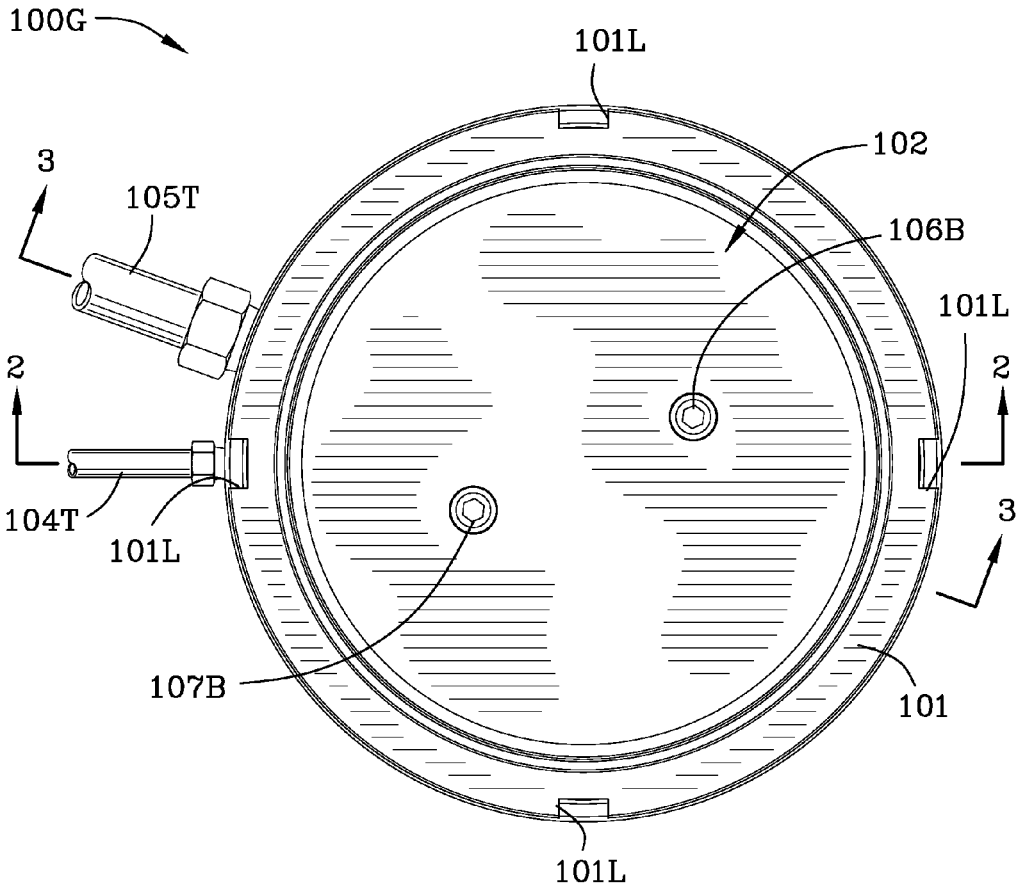
FIG. 1G is a top view of the first example of the adhesive applicator of FIG. 1.
Figure 1H:
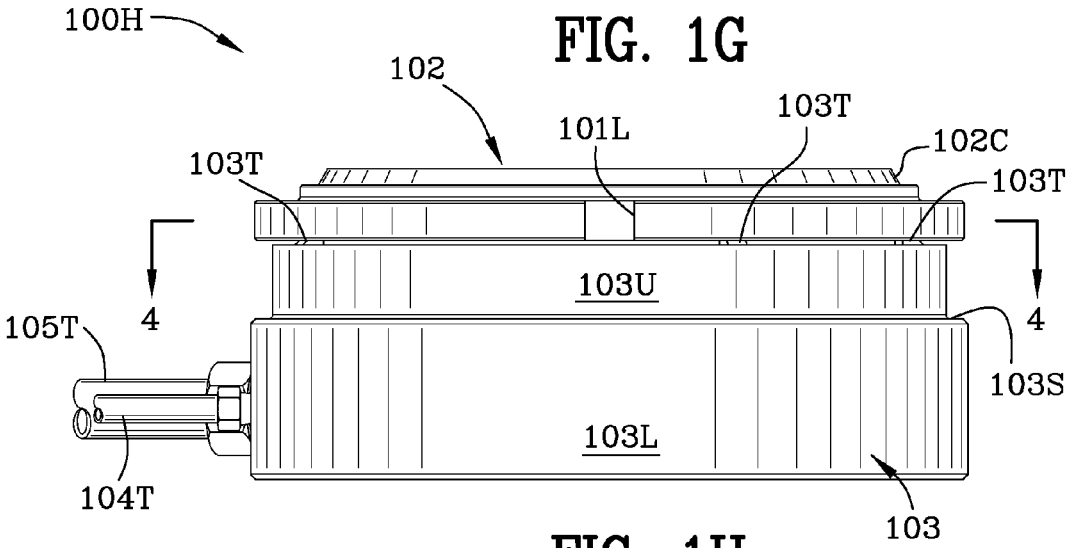
FIG. 1H is a front view of the first example of the adhesive applicator of FIG. 1G and FIG. 1.
Figure 2:
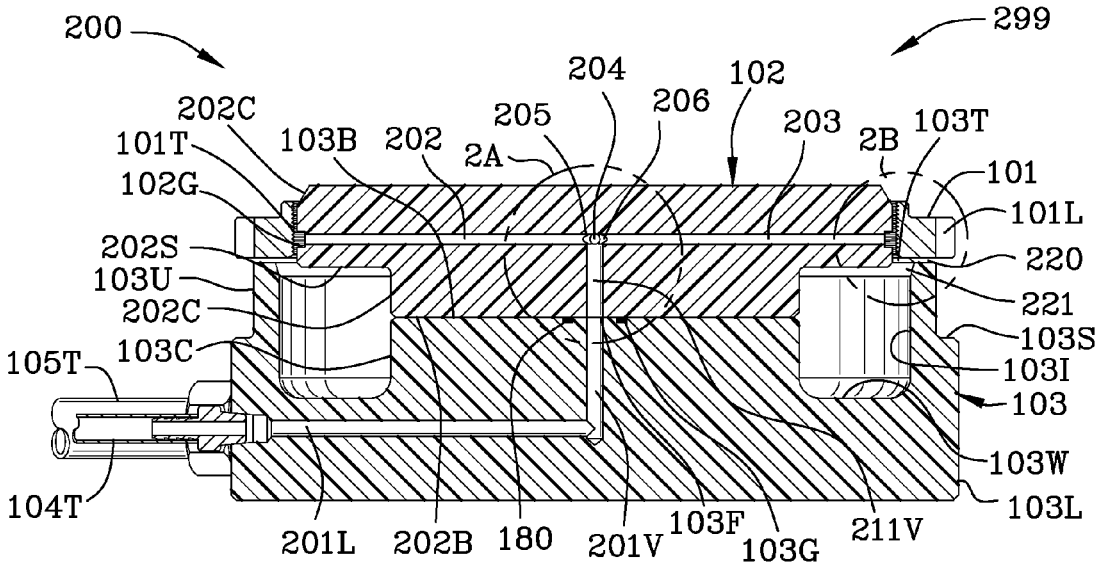
FIG. 2 is a cross-sectional view of the first example of the adhesive applicator taken along the lines 2-2 of FIG. 1G.

FIG. 1G is a top view 100G of the first example of the adhesive applicator 199 of FIG. 1. FIG. 1H is a front view 100H of the first example of the adhesive applicator 199 of FIG. 1G and FIG. 1 illustrating the bearing lock nut 101 engaging integral tabs 103T of the base portion 103.

Figure 2A:
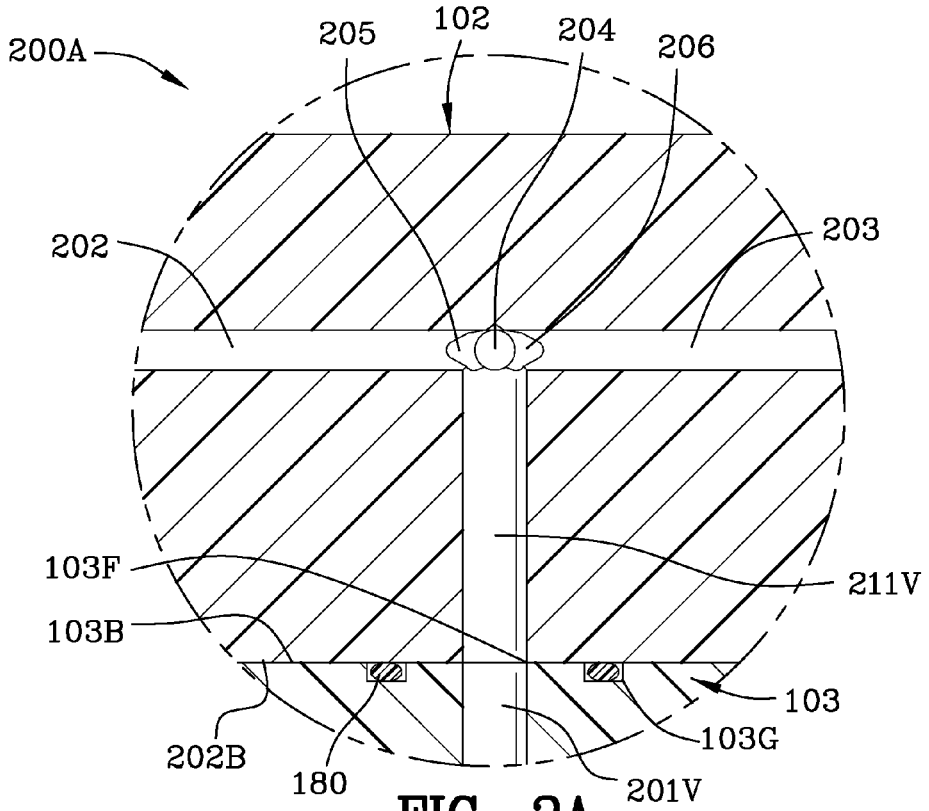
FIG. 2A is an enlargement of a portion of FIG. 2 illustrating the seal between the base portion of the applicator and the adhesive distributing portion of the first example of the adhesive applicator.

FIG. 2 is a cross-sectional view 200 of the first example of the adhesive applicator 199 taken along the lines 2-2 of FIG. 1G. Passageway 201L is shown in FIG. 2 extending from the pressure port (to which tube 104T is connected) to the center of base portion 103. Passageway 201V extends upwardly from passageway 201L to flow port 103F. Together passageways 201L and 201V are referred to as the first passageway in the base portion 103. Top surface 103B of the cylindrical portion 103C engages bottom surface 202B of the adhesive distributing portion 102. FIG. 2A is an enlargement of a portion 200A of FIG. 2 illustrating the seal 180 between the upper surface 103B of the base portion 103 of the adhesive applicator and the bottom surface 202B of the adhesive distributing portion 102 of the first example of the adhesive applicator 199.

Still referring to FIG. 2, the first passageway 201L, 201V is in fluidic communication with vertical passageway 211V of the adhesive distributing portion 102. Vertical passageway 211V is in communication with radially extending passageways 202, 203, 204, 205, 206, 207, 208, and 209. Sometimes herein the vertical passageway 211V in combination with any one of the radially extending passageways 202, 203, 204, 205, 206, 207, 208, and 209 is referred to herein as the second passageway. Sometimes herein the vertical passageway 211V in combination with all of the radially extending passageways 202, 203, 204, 205, 206, 207, 208, and 209 is referred to herein as a plurality of second passageways or as just a plurality of passageways. Reference numeral 202T denotes the top of the adhesive distributing portion.

Figure 2B:
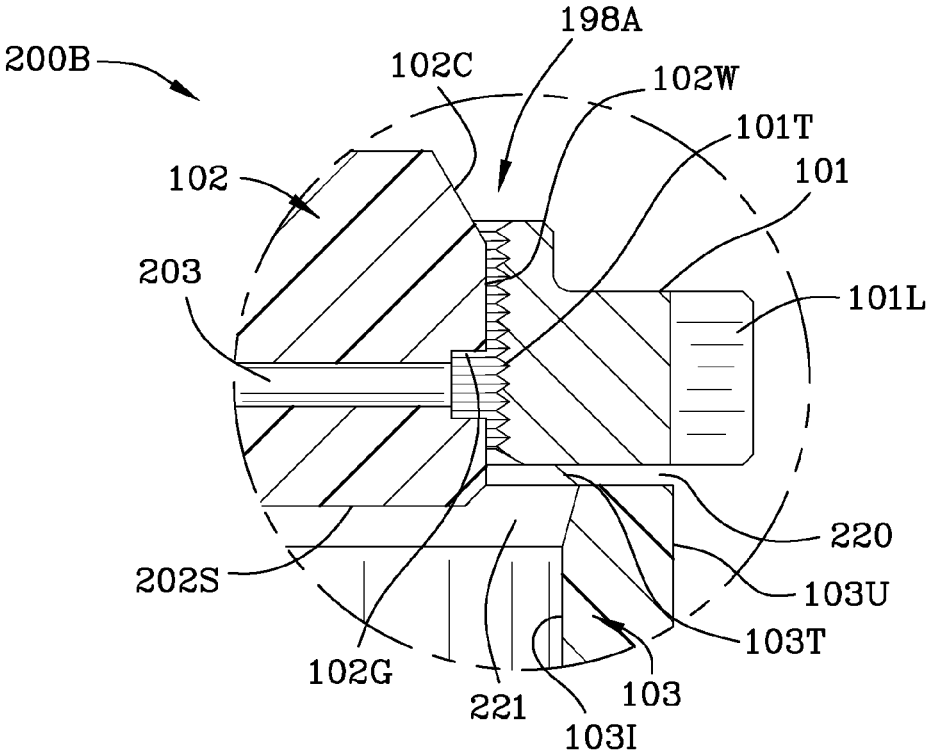
FIG. 2B is an enlargement of a portion of FIG. 2 illustrating the threaded fastener, a passageway in the adhesive distributing portion for communicating adhesive to a circumferential groove in the adhesive distributing portion, a gap between the threaded fastener and the upper portion of the base portion, and an opening leading to the well in the lower portion of the base portion.
Figure 2C:
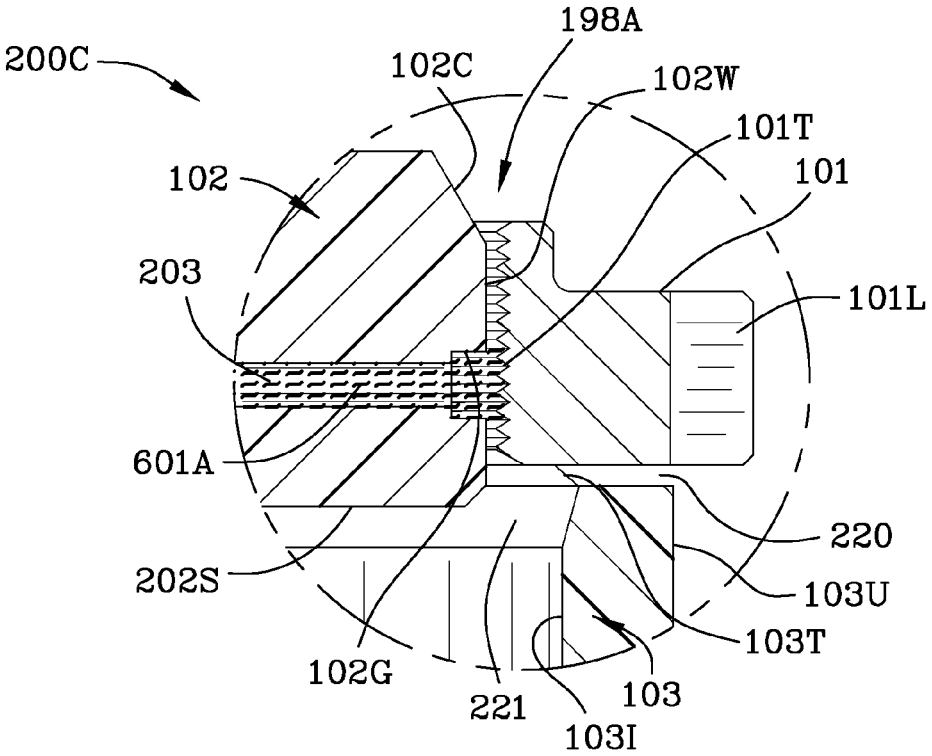
FIG. 2C is the same as FIG. 1B only adhesive is shown in the passageway in the adhesive distributing portion, adhesive is shown in the circumferential groove in the adhesive distributing portion, and, adhesive is shown in the gap between the threaded fastener and the upper portion of the base portion completely coating the threads of the threaded fastener proximate the gap.
Figure 3:
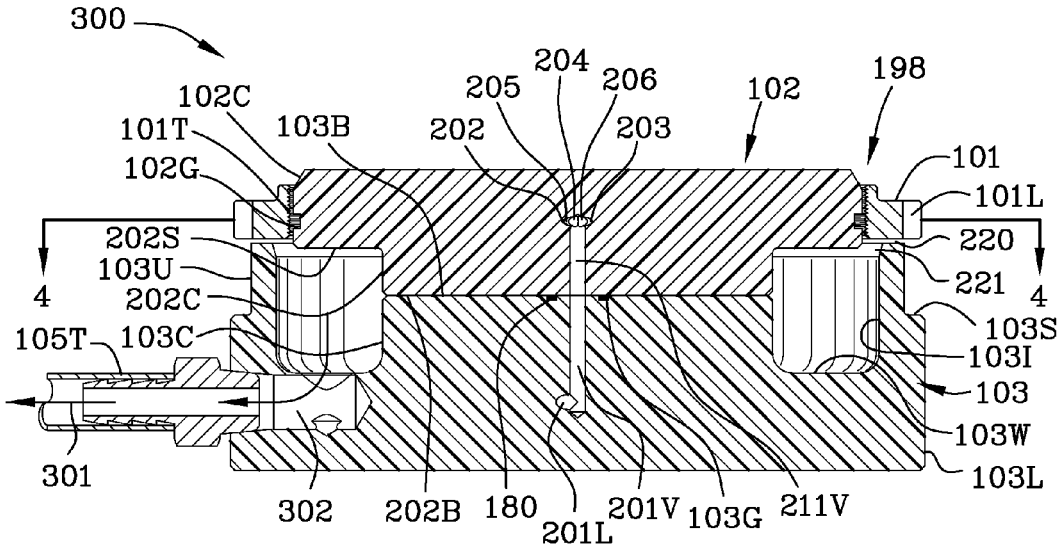
FIG. 3 is a cross-sectional view of the first example of the adhesive applicator taken along the lines 3-3 of FIG. 1G.
Figure 4:
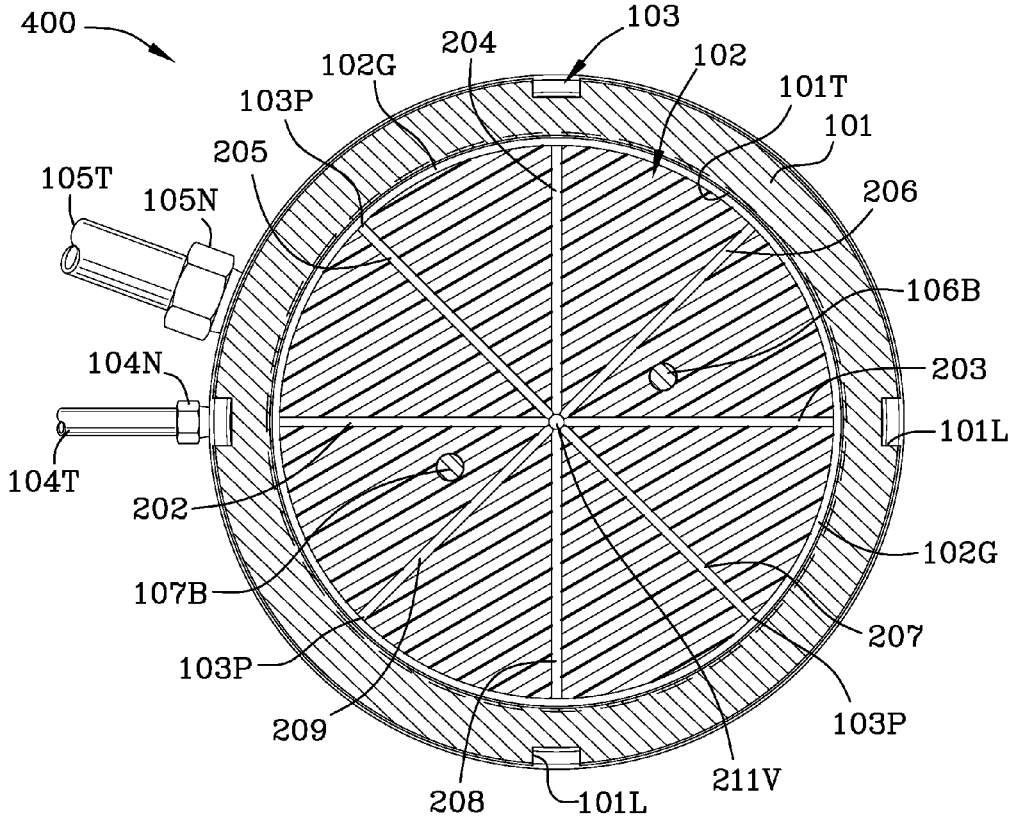
FIG. 4 is a cross-sectional view of the first example of the adhesive applicator taken along the lines 4-4 of FIG. 3 and FIG. 1H

FIG. 4 is a cross-sectional view 400 of the first example of the adhesive applicator 199 taken along the lines 4-4 of FIG. 3 and FIG. 1H and illustrates passageways 211V, 202, 203, 204, 205, 206, 207, 208, and 209. Passageways 202, 203, 204, 205, 206, 207, 208, and 209 extend radially to circumferential groove 102G. Adhesive extends radially in passageways 202, 203, 204, 205, 206, 207, 208, and 209 and spreads circumferentially in groove 102G. Referring to FIGS. 2B and 2C, the adhesive as it is being pumped in the passageways extends radially outwardly into the gap 198A and proceeds into the thread pattern adjacent groove 102G. As the adhesive extends radially outwardly it also extends circumferentially in the circumferential groove 102G. In the adhesive distributing portion described herein there are 8 radially extending passageways. Other examples may use more or less radially extending passageways depending on the configuration of the threaded device whose threads are to be coated. For instance, if the threaded device includes numerous threads which extend a considerable length then more radially extending passageways may be used. Further, the flow rate and pressure of the adhesive may be adjusted by using a different pump that supplies more adhesive at a different pressure. Additionally, the size of the circumferential groove may be adapted to accommodate the threads to be coated. The internally threaded device whose threads are coated is then mated with a reciprocally threaded device which spreads the adhesive into all of the threads of the internally threaded device and which spreads adhesive into all of the threads of the reciprocally threaded device.

FIG. 3 is a cross-sectional view 300 of the first example of the adhesive applicator 199 taken along the lines 3-3 of FIG. 1G. FIG. 3 illustrates the vertical passageways 201V and 211V. As stated previously passageway 201V is part of the first passageway of the base portion and passageway 211V is part of the second passageway(s) of the adhesive distributing portion 102. FIG. 3 also illustrates drain passageway 302 and flow arrow 301 denoting the path of unused adhesive being returned to the adhesive reservoir. Drain well 103W extends 360° within the base portion 103.

FIG. 2B is an enlargement 200B of a portion of FIG. 2 illustrating the threaded fastener 101, a passageway 203 in the adhesive distributing portion 102 for communicating adhesive 601A to a circumferential groove 102G in the adhesive distributing portion 102, a gap between the threaded fastener 101 and the upper portion 103U of the base portion 102, and an opening 221 leading to the well 103W in the lower portion 103L of the base portion 103. Reference numeral 198A denotes a gap between the threads 101T of the bearing lock nut 101 and the wall surface 102W of the adhesive distributing portion.

FIG. 2C is the same view 200C as FIG. 1B only: adhesive 601A is shown in the passageway 203 in the adhesive distributing portion 102, adhesive is shown in the circumferential groove 102G in the adhesive distributing portion, and adhesive is shown in the gap between the threaded fastener 101 and the upper portion 103U of the base portion 103 completely coating the threads 101T of the threaded fastener 101.

Figure 5:
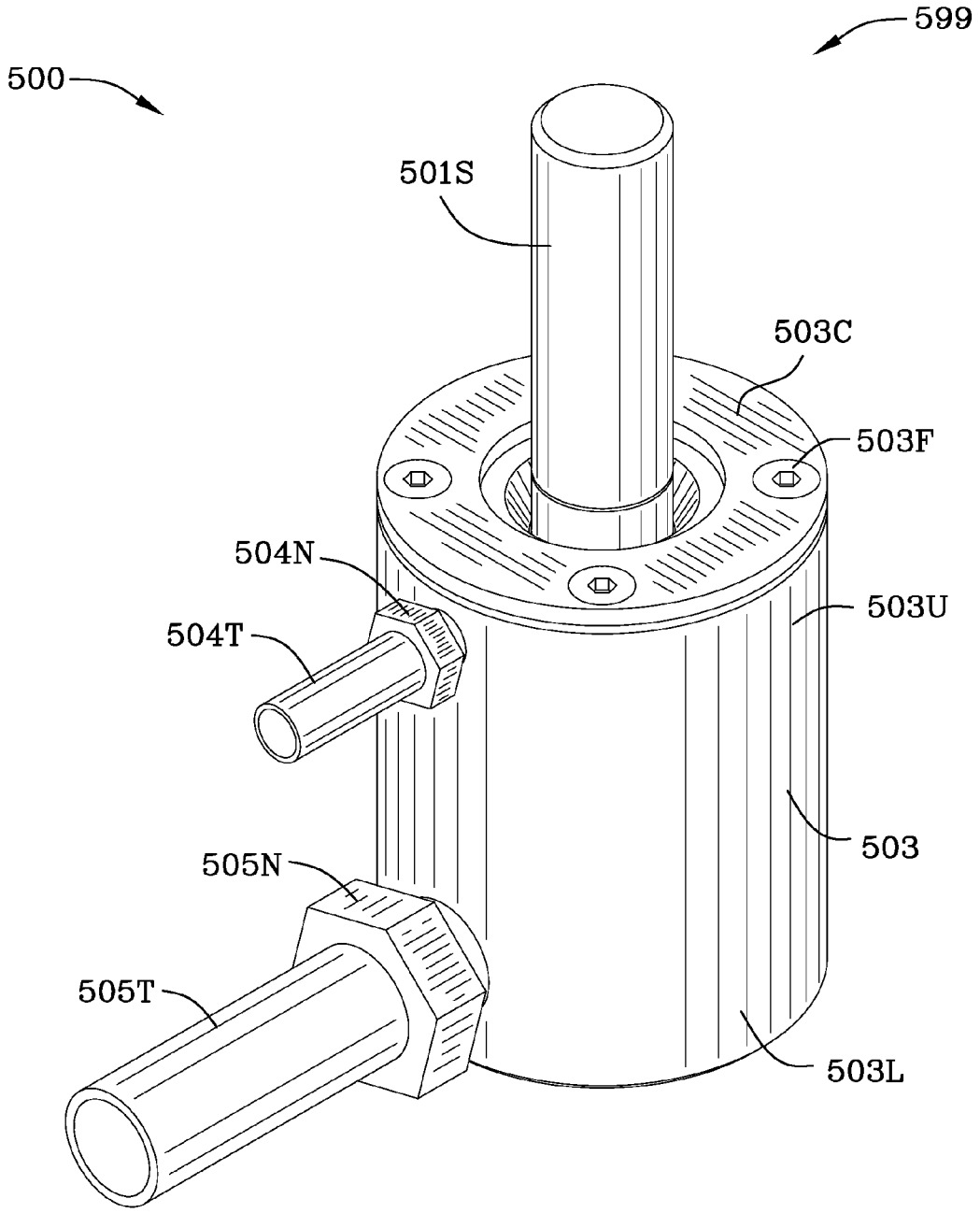
FIG. 5 is a perspective view of the second example of the adhesive applicator illustrating the pressure tube, the drain tube, and the base portion.

FIG. 5 is a perspective view 500 of the second example of the adhesive applicator 599 illustrating the pressure tube 504T and nut 504N securing the tube with respect to the applicator 599, the drain tube 505T and nut 505N securing the tube with respect to the applicator 599, and the base portion 503. Cap 503C is secured to the base portion 503 with fasteners 503F. Threaded stud 501S is shown protruding from the second example of the adhesive applicator 599. Tapered surface 506T of the adhesive distributing portion 506A is also illustrated in FIG. 5.

Figure 5A:
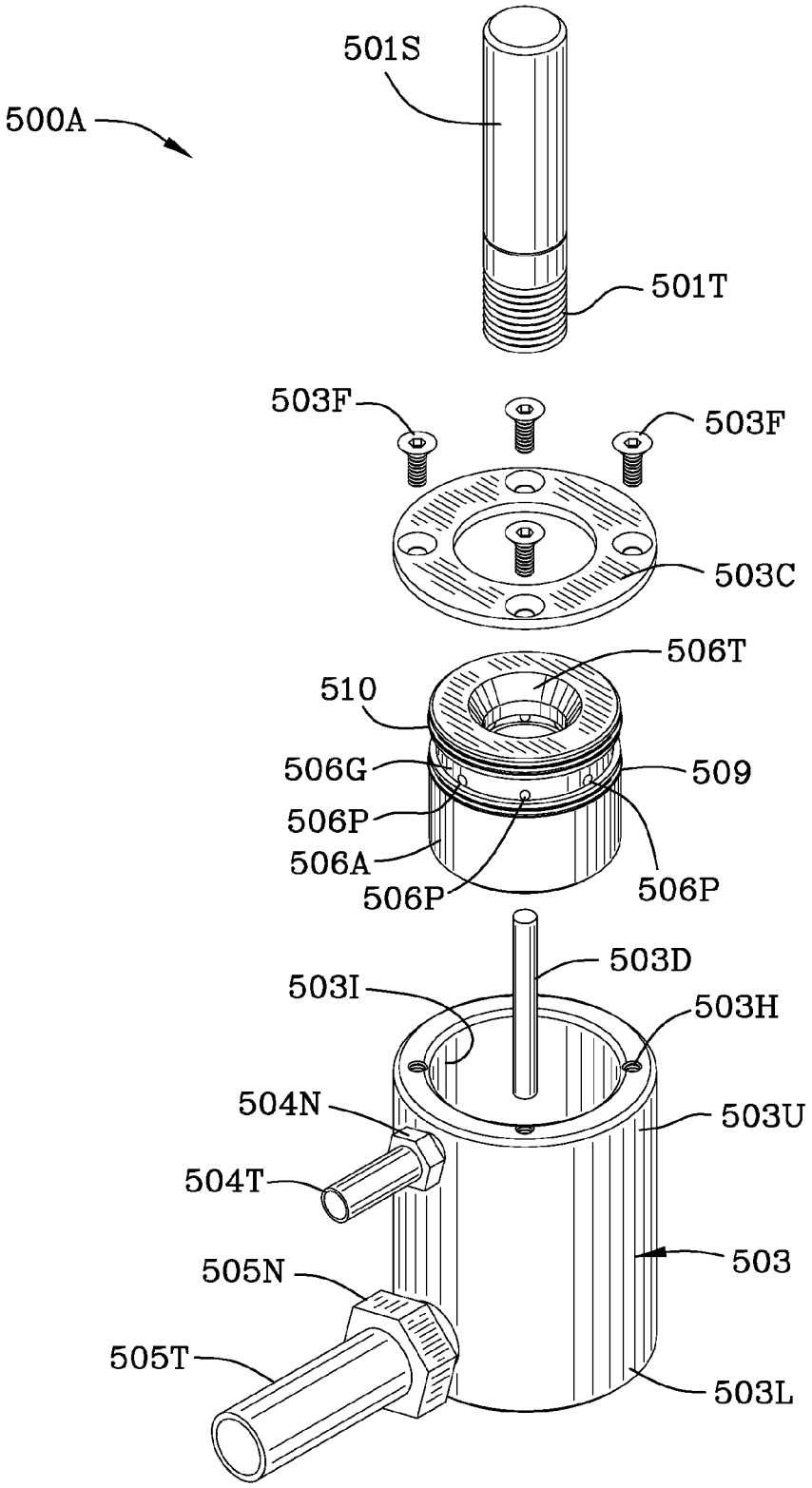
FIG. 5A is an exploded perspective view of the second example of the adhesive applicator illustrating the pressure tube, the drain tube, the base portion, the adhesive distributing portion, the externally threaded stud and the cap portion.
Figure 5C:
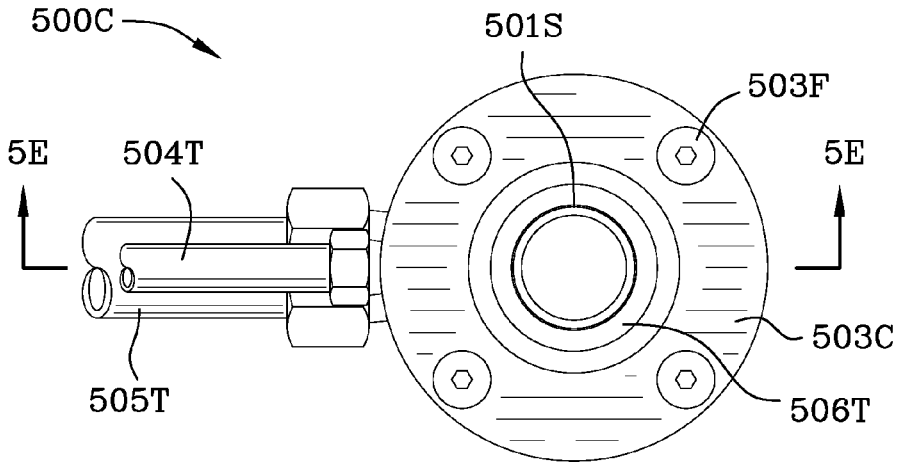
FIG. 5C is a top view of the second example of the adhesive applicator.

FIG. 5A is an exploded perspective view 500A of the second example of the adhesive applicator 599 illustrating the pressure tube 504T, the drain tube 505T, the base portion 503, the adhesive distributing portion 506A, and the cap portion 503C. Base portion 506 includes lower portion 503L and upper portion 503U. Threaded holes 503H in the upper portion 503U of the base portion 503 receive fasteners 503F to secure the adhesive distributing portion 506A within the base portion 503. Adhesive distributing portion 506A includes a bottom 506B which engages an inner shoulder 503S of the base portion 503 and the adhesive distributing portion 506A is supported thereby. See FIG. 5E, a cross-sectional view 500E of the second example of the adhesive applicator 599 taken along the lines 5E-5E of FIG. 5C. FIG. 5C is a top view 500C of the second example of the adhesive applicator 599.

Referring again to FIGS. 5A and 5E, depth stop 503D is illustrated and functions to control the insertion depth of the threaded stud 501S within the adhesive applicator 599. Threaded stud includes exterior threads 501T which fits within the adhesive distributing portion 506A. Tapered surface 506T guides the stud 501S as it is placed within the adhesive distributing portion 506A. Adhesive distributing portion 506A includes an inner bore 506I and an exterior 506E. A groove 506G extends circumferentially around the exterior of the adhesive distributing portion 506A and discharge ports 506P expel adhesive therefrom. Adhesive 601A is expelled radially out the discharge ports and the adhesive also spreads in the circumferential groove 506G.

Figure 5B:
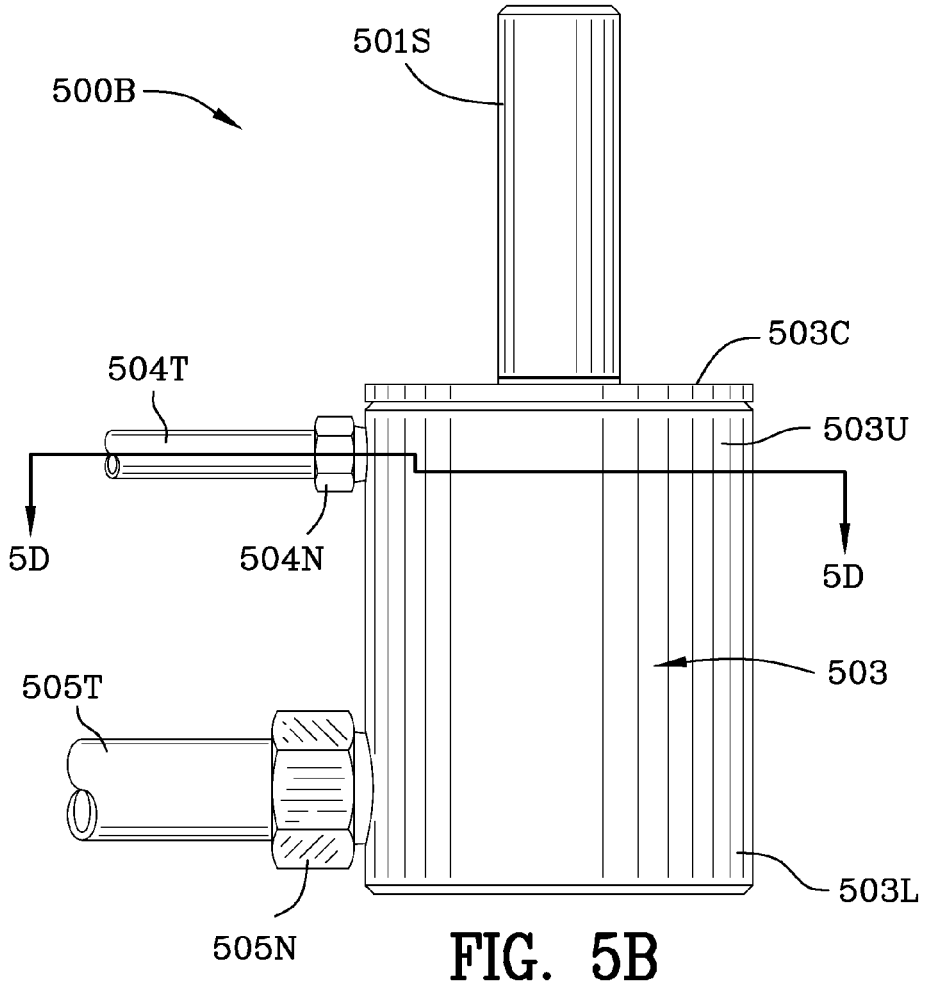
FIG. 5B is a front view of the second example of the adhesive applicator illustrating the pressure tube, the drain tube, the base portion, the cap and the threaded stud.
Figure 5D:
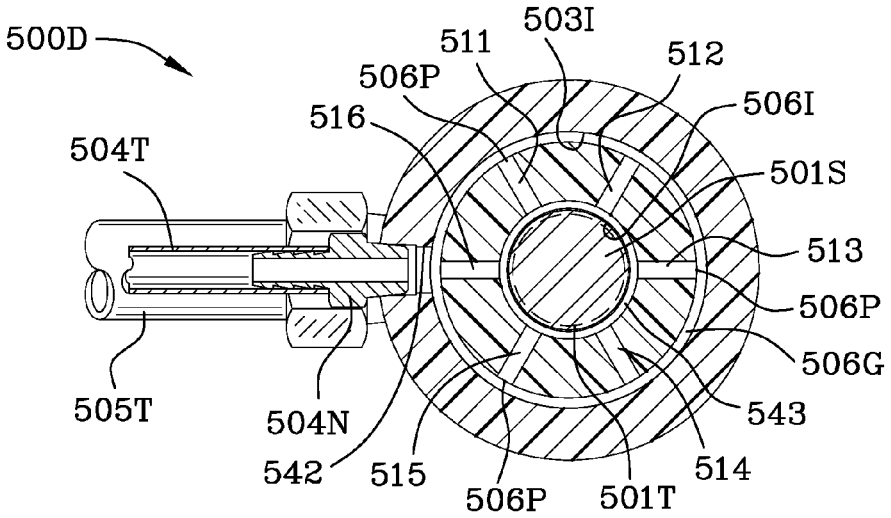
FIG. 5D is a cross-sectional view of the second example of the adhesive applicator taken along the lines 5D-5D of FIG. 5B illustrating the pressure tube, the drain tube, the circumferentially extending groove, and radially extending passageways for supplying adhesive to the threaded stud.
Figure 5E:
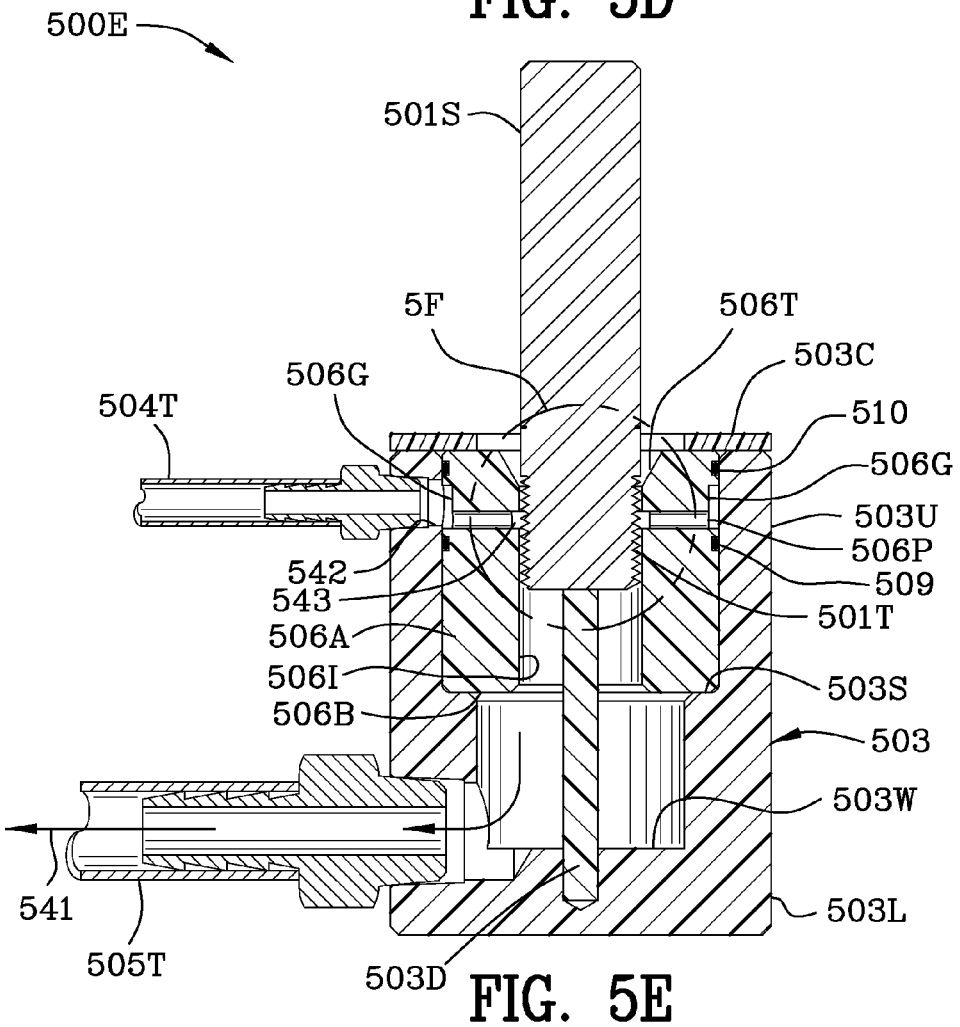
FIG. 5E is a cross-sectional view of the second example of the adhesive applicator taken along the lines 5E-5E of FIG. 5C.

Referring to FIG. 5E, the depth stop 503D limits the position of the externally threaded stud 501S as shown. Depth stop 503D resides in bore 540B and is supported thereby. Flow path 541 of unused adhesive is illustrated in FIG. 5E. Stud 501S fits within the inner bore 506I of the adhesive distributing portion 506A. A first passageway 542 in the upper portion 503U communicates with the exterior circumferential groove 506G of the adhesive distributing portion 506A. As anaerobic adhesive is pumped into groove 506G it spreads circumferentially between the inner wall 503I of the base portion 503 and the exterior groove 506G of the adhesive distributing portion 506A. Groove 506G, in turn, is interconnected with a plurality of inwardly radially extending second passageways 511, 512, 513, 514, 515 and 516 which terminate in a circumferentially extending internal groove or annulus 543 in which adhesive spreads circumferentially in groove 543. Simultaneously with the circumferential spread of adhesive, the adhesive continues radially inwardly to coat the threads adjacent annulus 543. Gap 549A exists between threads 501T of stud 501A and the inner bore 506I of the adhesive distributing portion 506A. Unused adhesive falls downwardly in gap 549A under the influence of gravity into well 503W of the base portion 503. Threaded stud 501S is centered by the inner circumferentially shaped surface 506I. Even if the stud 501S is somewhat off-center, the threads are sufficiently coated. Radially extending second passageways 511, 512, 513, 514, 515 and 516 are sealed by two elastomeric seals 509, 510 which reside in unnumbered grooves in the exterior of the adhesive distributing portion 506A.

Referring to FIGS. 5, 5A and 5E, tapered surface 506T of the adhesive distributing portion aids insertion of the threaded stud 501S. FIG. 5B is a front view 500B of the second example of the adhesive applicator 599 illustrating the pressure tube, the drain tube, the base portion, the cap and the threaded stud. FIG. 5D is a cross-sectional view 500D of the second example of the adhesive applicator 599 taken along the lines 5D-5D of FIG. 5B illustrating the pressure tube, the drain tube, the circumferentially extending groove 506G, the radially extending passageways 511, 512, 513, 514, 515 and 516 for supplying adhesive to the threaded stud, and the internal circumferential groove 543 extending about threads 501T of the stud. Gap 549A between the threads 501T and the inner bore 506I of the adhesive distributing portion 506 is illustrated in FIGS. 5D, 5E, and 5F.

Figure 5F:
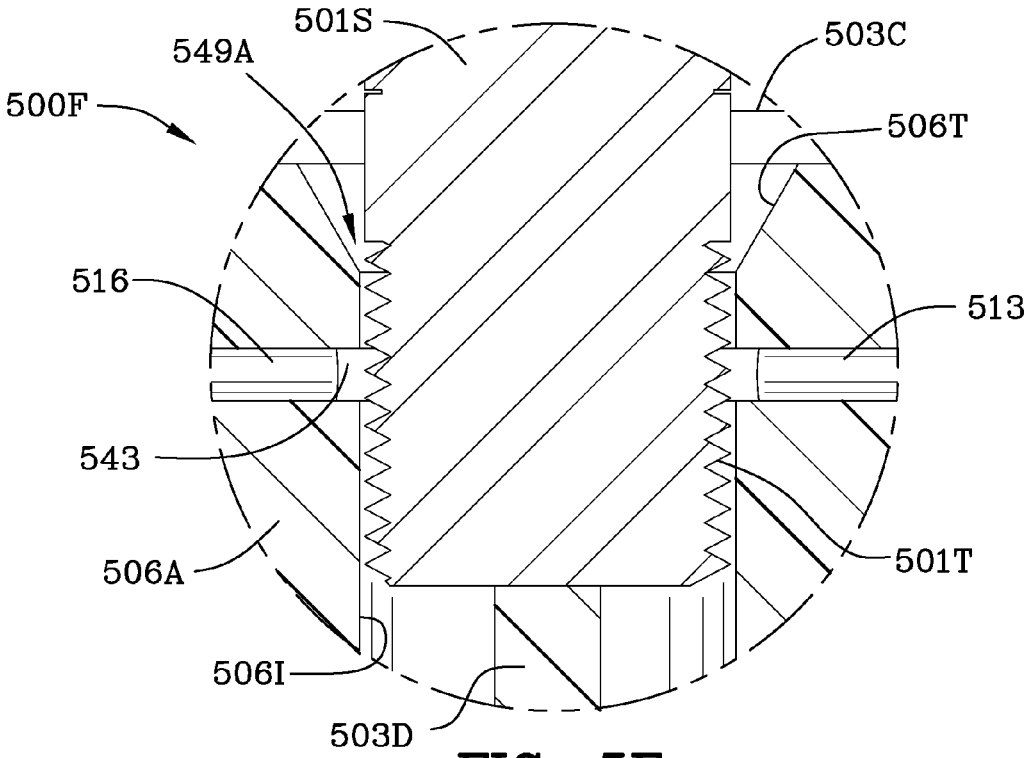
FIG. 5F is an enlargement of a portion of FIG. 5E illustrating the externally threaded stud and an annulus for spreading adhesive around the externally threaded stud.
Figure 5G:
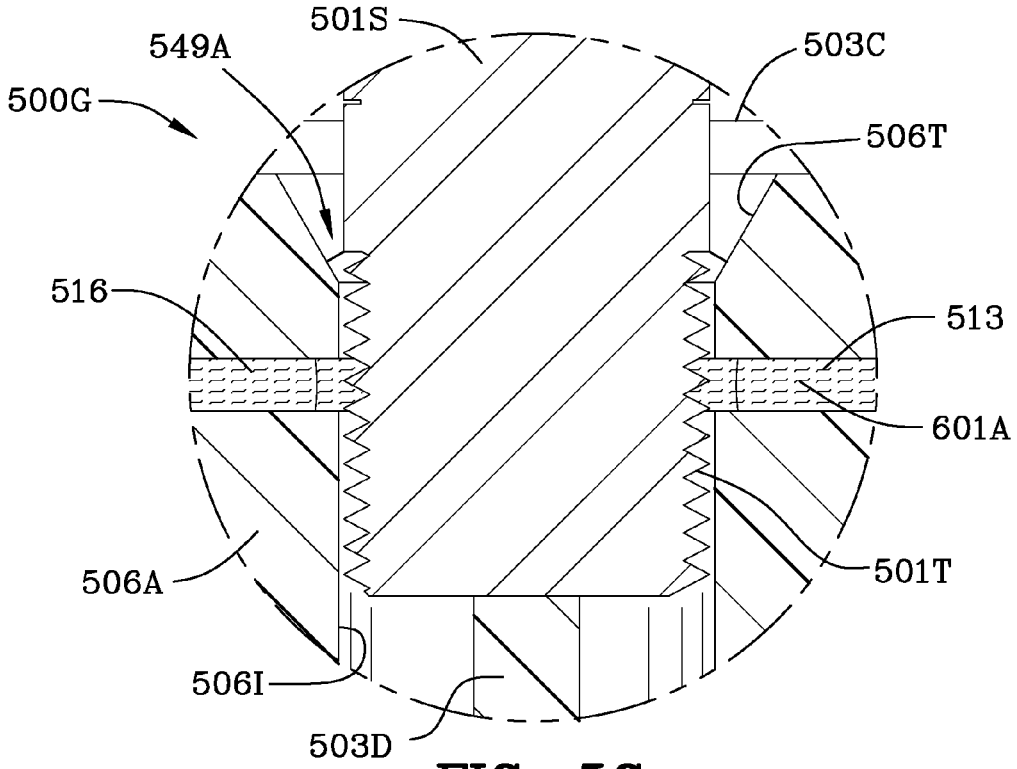
FIG. 5G is similar to FIG. 5F but additionally illustrates the adhesive in the annulus and surrounding the externally threaded stud.

FIG. 5F is an enlargement 500F of a portion of FIG. 5E illustrating circumferentially extending internal groove or annulus 543 in which adhesive spreads circumferentially therein. Gap 549A between the threads 501T and the inner bore 506I of the adhesive distributing portion 506 is illustrated well in FIG. 5E. FIG. 5G is a view 500G similar to FIG. 5F but additionally illustrates adhesive 601A in the annulus 543 and surrounding a portion of the externally threaded stud 501T. When the externally threaded stud partially coated with adhesive mates with a reciprocally threaded device, the adhesive is shared between all of the threads of the stud and all of the threads of the reciprocally threaded device.

A process of applying adhesive to an internally threaded device is disclosed and claimed which includes the step of placing the threaded device 101 upon the base portion 103 of the adhesive applicator 199. The base portion 103 supports the threaded device 101. Pumping anaerobic adhesive is performed utilizing a peristaltic pump 601P to avoid contact of the anaerobic adhesive 601A with the metal components of the pump. Rollers of the peristaltic pump 601P compress a flexible tube 104S pushing and forcing the anaerobic adhesive through the tube without contacting any metal parts of the pump. The anaerobic adhesive 601A does not adhere to plastic or elastomeric materials. The tubing used is oxygen permeable to prevent the anaerobic adhesive from setting up. The peristaltic pump supplies anaerobic adhesive from a reservoir 601R to the adhesive applicator 199 for coating the external threads 101T of a threaded device. The adhesive is routed through a first passageway 201L, 201V in the base portion 103 of the adhesive applicator 199 and then it is routed through a plurality of passageways 211V, 202, 203, 204, 205, 206, 207, 208, 209 in the adhesive distributing portion 102 of the adhesive applicator 199. Adhesive is discharged from the plurality of passageways to the exterior of the adhesive distributing portion of the adhesive applicator and the threaded device surrounds the exterior of the adhesive distributing portion proximate the threaded device. Adhesive is forced into a gap 198A between the adhesive distributing portion 102 and the threaded device 101 and the threads 101T of the threaded device are coated with the adhesive.

The step of discharging adhesive from the plurality of passageways to the exterior of the adhesive distributing portion proximate the threaded device is followed by the step of spreading the adhesive in a circumferential groove 102G in the exterior wall 102W of the adhesive distributing portion 102 of the adhesive applicator proximate the threaded device. The plurality of passageways in the adhesive distributing portion of the adhesive applicator are radial extending passageways. An additional step of draining excess adhesive from the gap 198A between the adhesive distributing portion and the threaded device is also preferably performed in the process.

A process of applying adhesive to an externally threaded device 501A includes the steps of placing the threaded device upon a depth stop 503D which controls the depth of insertion of the threaded device or stud into the adhesive applicator 599. Externally threaded devices may involve the use of a depth stop 503D that is calibrated or sized for the location of the threads 501T on the stop. The depth stop 501T engages the base portion 503 and the depth stop supports the threaded device. Adhesive is pumped utilizing a peristaltic pump 601P from an adhesive reservoir 601R to the adhesive applicator 599 for coating external threads 501T of the threaded device. Adhesive is routed through a first passageway 542 in the base portion of the adhesive applicator and it then spreads and flows in a circumferential groove 506G in the exterior of the adhesive distributing portion 506A of the adhesive applicator 599. The adhesive is routed through a plurality of passageways 511, 512, 513, 514, 515, 516 in the adhesive distributing portion 506A of the adhesive applicator and is discharged from the plurality of passageways to an annulus 543 in the interior of the adhesive distributing portion of the adhesive applicator. The adhesive distributing portion surrounds the threaded device 501S and forces adhesive into a gap 549A between the adhesive distributing portion and the threaded device coating the threads of the threaded device with the adhesive. The plurality of passageways in the adhesive distributing portion of the adhesive applicator are inwardly extending radial passageways. Preferably, excess adhesive is drained from the gap between the adhesive distributing portion and the threaded device.

REFERENCE NUMERALS

100—perspective view of the first example of the adhesive applicator illustrating the pressure tube, the drain tube, the base portion, and the adhesive distributing portion of the applicator with a threaded fastener placed around the adhesive distributing portion of the applicator.

100A—perspective view of the first example of the adhesive applicator illustrating the pressure tube, the drain tube, the base portion, and the adhesive distributing portion of the applicator without a threaded fastener placed around the adhesive distributing portion of the applicator

100B—an exploded perspective view of the first example of the adhesive applicator illustrated in FIG. 1

100C—an enlarged portion of FIG. 1B illustrating the threaded fastener

100D—an enlarged portion of FIG. 1B illustrating the adhesive distributing portion of the first example of the adhesive applicator

100E—a front view of the adhesive distributing portion of the first example of the adhesive applicator illustrated in FIGS. 1D, 1B and 1A

100F—a bottom view of the adhesive distributing portion of the first example of the adhesive applicator illustrated in FIGS. 1D, 1B and 1A

100G—a top view of the first example of the adhesive applicator of FIG. 1

100H—a front view of the first example of the adhesive applicator of FIG. 1G and FIG. 1.

101—threaded fastener, bearing nut

101C—cylindrical lip on fastener

101L—lug of fastener

101T—threaded interconnection on fastener

102—adhesive distributing portion of adhesive applicator

102C—chamfered edge of adhesive distributing portion

102G—circumferential groove in exterior of adhesive distributing portion

102H—through holes in the adhesive distributing portion

102P—ports for delivering adhesive to threaded fastener

102W—wall of adhesive distributing portion

103—base portion

103B—top surface of adhesive applicator which engages the adhesive distributing portion

103C—integral cylindrical portion of base portion of adhesive applicator
103F—fluid supply port in integral cylindrical portion
103G—circular seal recess
103H—threaded receptacles which received threaded bolts 106B, 107B
103L—lower portion of base portion
103R—seal
103S—shoulder on the exterior of the adhesive applicator
103U—upper portion of base portion of adhesive applicator
103W—well in the base portion collecting adhesive
104N—nut securing pressure tube
104S—supply hose to adhesive applicator
104T—pressure supply tube
105N—nut securing drain tube
105R—return line to reservoir 601R
105T—drain tube
106B—plastic bolt
107B—plastic bolt
180—elastomeric seal
198—slot between adhesive distributing portion 102 and base portion 103
199—first example of adhesive applicator
200—a cross-sectional view of the first example of the adhesive applicator taken along the lines 2-2 of FIG. 1G
200A—an enlargement of a portion of FIG. 2 illustrating the seal between the base portion of the applicator and the adhesive distributing portion of the first example of the adhesive applicator
200B—an enlargement of a portion of FIG. 2 illustrating the threaded fastener, a passageway in the adhesive distributing portion for communicating adhesive to a circumferential groove in the adhesive distributing portion, a gap between the threaded fastener and the upper portion of the base portion, and an opening leading to the well in the lower portion of the base portion
201L—passageway in lower portion of base portion carrying adhesive from the exterior of the base portion to the a vertical passageway 201V
201V—vertical passageway in lower portion of base portion communicating adhesive
211V—vertical passageway in adhesive distributing portion of the adhesive applicator
202, 203, 204, 205, 206, 207, 208, 209—radially extending passageway from the vertical passageway 211V to groove 103 in the exterior of the adhesive distributing portion
202B—base of adhesive distributing portion 102
202C—lower cylindrical portion of adhesive distributing portion 102
202S—shoulder portion of adhesive distributing portion 102
202T—top of adhesive distributing portion 102
220—gap between threaded fastener 101 and upper portion 103U of base portion
221—drain port
223C—adhesive in passageway
299—first example of adhesive applicator in cross-section
300—a cross-sectional view of the first example of the adhesive applicator taken along the lines 3-3 of FIG. 1G
301—arrow indicating the drainage of unused adhesive
302—port drainage of unused adhesive
400—a cross-sectional view of the first example of the adhesive applicator taken along the lines 4-4 of FIG. 3 and FIG. 1H
500—a perspective view of the second example of the adhesive applicator illustrating the pressure tube, the drain tube, and the base portion
500A—an exploded perspective view of the second example of the adhesive applicator illustrating the pressure tube, the drain tube, the base portion, the adhesive distributing portion, and the cap portion.
500B—a front view of the second example of the adhesive applicator illustrating the pressure tube, the drain tube, the base portion, the cap and the threaded stud
500C—a top view of the second example of the adhesive applicator
500D—a cross-sectional view of the second example of the adhesive applicator taken along the lines 5D-5D of FIG. 5B illustrating the pressure tube, the drain tube, the circumferentially extending groove, and radially extending passageways for supplying adhesive to the threaded stud
500E—a cross-sectional view of the second example of the adhesive applicator taken along the lines 5E-5E of FIG. 5C
500F—enlarged portion of FIG. 5E
501S—threaded stud with exterior threads
501T—thread on stud
503—base portion, second example
503C—cap
503D—depth measure
503F—fastener for caps
503H—holes in base portion for receiving studs
503I—inner surface of base portion
503L—lower portion of base portion
503S—internal shoulder in the base portion
503U—upper portion of the base portion
503W—adhesive well
504N—nut for securing pressure supply tube
504T—pressure supply tube
505N—nut for securing drain supply tube
505T—drain tube
506A—adhesive distributing portion
506B—base or bottom portion of adhesive distributing portion
506E—exterior of the adhesive distributing portion
506G—circumferential groove in the adhesive distributing portion
506I—inner bore of adhesive distributing portion
506P—ports in the adhesive distributing portion
506T—tapered wall of adhesive distributing portion forming a cone
509, 510—O-ring
511, 512, 513, 514, 515, 516—radial passageways extending from the circumferential groove 506G to the interior 506I of the adhesive distributing portion 506A
540B—bore supporting depth stop 503D
541—path of unused adhesive returning to adhesive reservoir
542—first passageway in base portion
543—circumferentially extending internal groove or annulus in which adhesive spreads circumferentially
549A—gap between inner wall 506I of the adhesive distributing portion and threads of the stud
599—second example of the adhesive applicator
600—a schematic view of a peristaltic pump, an adhesive reservoir, and the first example of the adhesive applicator
601A—adhesive
601P—peristaltic adhesive pump
601R—reservoir of adhesive
600A—a schematic view of a peristaltic pump, an adhesive reservoir, and the second example of the adhesive applicator Those skilled in the art will recognize that the invention has been set forth by way of example only and that changes and modifications may be made to the examples given without departing from the spirit and scope of the attached claims.

The invention claimed is:

1. A process of applying adhesive to a threaded device, comprising the steps of:

placing said threaded device upon a base portion of an adhesive applicator, said base portion supporting said threaded device;

pumping anaerobic adhesive, utilizing a peristaltic pump, from an adhesive reservoir to said adhesive applicator for coating threads of said threaded device;

routing said adhesive through a first passageway in said base portion of said adhesive applicator;

routing said adhesive through a plurality of passageways in an adhesive distributing portion of said adhesive applicator;

discharging adhesive from said plurality of passageways to an exterior of said adhesive distributing portion of said adhesive applicator, said threaded device surrounding said exterior of said adhesive distributing portion proximate said threaded device;

forcing adhesive into a gap between said adhesive distributing portion and said threaded device; and, coating said threads of said threaded device with said adhesive.

2. The process of applying adhesive to a threaded device as claimed in claim 1 wherein said step of discharging adhesive from said plurality of passageways to said exterior of said adhesive distributing portion proximate said threaded device is followed by the step of spreading said adhesive in a circumferential groove in said exterior of said adhesive distributing portion of said adhesive applicator proximate said threaded device.

3. The process of applying adhesive to a threaded device as claimed in claim 2 wherein said plurality of passageways in said adhesive distributing portion of said adhesive applicator are radial passageways.

4. The process of applying adhesive to a threaded device as claimed in claim 1, further comprising the step of:

draining excess adhesive from said gap between said adhesive distributing portion and said threaded device.

5. The process of applying adhesive to a threaded device as claimed in claim 4 wherein said plurality of passageways in said adhesive distributing portion of said adhesive applicator are radial passageways.

* * * * *